US008715432B2

(12) United States Patent
Hasegawa et al.

(10) Patent No.: US 8,715,432 B2
(45) Date of Patent: May 6, 2014

(54) FIRE-RESISTANT STEEL SUPERIOR IN WELD JOINT REHEAT EMBRITTLEMENT RESISTANCE AND TOUGHNESS AND METHOD OF PRODUCTION OF SAME

(75) Inventors: Yasushi Hasegawa, Tokyo (JP); Masaki Mizoguchi, Tokyo (JP); Yoshiyuki Watanabe, Tokyo (JP); Suguru Yoshida, Tokyo (JP); Tadayoshi Okada, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 542 days.

(21) Appl. No.: 12/452,200

(22) PCT Filed: Mar. 24, 2009

(86) PCT No.: PCT/JP2009/056411

§ 371 (c)(1),
(2), (4) Date: Dec. 17, 2009

(87) PCT Pub. No.: WO2009/123076

PCT Pub. Date: Oct. 8, 2009

(65) Prior Publication Data

US 2010/0132855 A1 Jun. 3, 2010

(30) Foreign Application Priority Data

Mar. 31, 2008 (JP) ..... 2008-090571
Feb. 4, 2009 (JP) ..... 2009-023777

(51) Int. Cl.

| | |
|---|---|
| ***C21D 6/02*** | (2006.01) |
| ***C21D 8/02*** | (2006.01) |
| ***C22C 38/00*** | (2006.01) |
| ***C22C 38/22*** | (2006.01) |
| ***C22C 38/44*** | (2006.01) |

(52) U.S. Cl.
USPC ..... 148/624; 148/654; 148/331; 148/332; 148/333; 148/334; 148/335

(58) Field of Classification Search
USPC ..... 148/624, 654, 331–335
See application file for complete search history.

(56) References Cited

U.S. PATENT DOCUMENTS

| | | | | | |
|---|---|---|---|---|---|
| 5,084,238 | A * | 1/1992 | Masuyama et al. | ..... | 420/109 |
| 6,162,307 | A * | 12/2000 | Hasegawa et al. | ..... | 148/334 |
| 6,379,611 | B1 * | 4/2002 | Komai et al. | ..... | 420/106 |
| 2006/0108035 | A1 | 5/2006 | Sun | | |
| 2006/0179974 | A1 * | 8/2006 | Hatano et al. | ..... | 75/228 |
| 2011/0129381 | A1 * | 6/2011 | Hasegawa et al. | ..... | 420/83 |

FOREIGN PATENT DOCUMENTS

| | | | | | |
|---|---|---|---|---|---|
| CN | 1168700 | | 12/1997 | | |
| JP | 57-063628 | * | 4/1982 | ..... | C21D 8/00 |
| JP | 07-286233 | | 10/1995 | | |
| JP | 10-96024 | | 4/1998 | | |
| JP | 2000-282167 | | 10/2000 | | |
| JP | 2001-294984 | | 10/2001 | | |
| JP | 2002-115022 | | 4/2002 | | |
| JP | 2006-002198 | * | 1/2006 | ..... | C22C 38/00 |
| JP | 2006-045580 | * | 2/2006 | ..... | C23D 5/00 |
| JP | 2007-119861 | | 5/2007 | | |
| JP | 2007-277679 | | 10/2007 | | |
| JP | 2007-277680 | | 10/2007 | | |
| WO | WO 96/17964 | | 6/1996 | | |
| WO | WO 2006/022053 A1 | * | 2/2006 | ..... | C22C 38/00 |

OTHER PUBLICATIONS

English Abstract and English Machine Translation of Murakami et al. (JP 2006-045580) (2006).*
English Translation of Tanaka (JP 57-063628).*
ASM International, Materials Park, Ohio, Properties and Selection: Irons, Steels, and High-Performance Alloys, vol. 1, "Notch Toughness of Steels", pp. 739-742.*
English Translation of Tanaka (JP 57-063628) (Apr. 1982).*
ASM International, Materials Park, Ohio, Properties and Selection: Irons, Steels, and High-Performance Alloys, vol. 1, "Notch Toughness of Steels", Mar. 1990, pp. 739-742.*
International Search Report dated Jun. 16, 2009 issued in corresponding PCT Application No. PCT/JP2009/0056411.

* cited by examiner

*Primary Examiner* — Jessee Roe
(74) *Attorney, Agent, or Firm* — Kenyon & Kenyon LLP

(57) ABSTRACT

The present invention provides high temperature strength and fire-resistant steel superior in weld joint reheat embrittlement resistance and toughness which is produced using steel of a room temperature strength of the 400 to 600N/mm$^2$ class containing as main ingredients C: 0.010% to less than 0.05%, Si: 0.01 to 0.50%, Mn: 0.80 to 2.00%, Cr: 0.50% to less than 2.00%, V: 0.03 to 0.30%, Nb: 0.01 to 0.10%, N: 0.001 to 0.010%, and Al: 0.005 to 0.10%, limiting the contents of Ni, Cu, Mo, and B, and satisfying the relationship of 4Cr[%]-5Mo[%]-10Ni[%]-2Cu[%]-Mn[%]>0.

6 Claims, 3 Drawing Sheets

FIRE-RESISTANT STEEL SUPERIOR IN WELD JOINT REHEAT EMBRITTLEMENT RESISTANCE AND TOUGHNESS AND METHOD OF PRODUCTION OF SAME

This application is a national stage application of International Application No. PCT/JP2009/056411, filed 24 Mar. 2009, which claims priority to Japanese Application No. 2008-090571, filed 31 Mar. 2008, and Japanese Application No. 2009-023777, filed 4 Feb. 2009, each of which is incorporated by reference herein in its entirety.

TECHNICAL FIELD

The present invention relates to fire-resistant steel used for forming a steel structure, in particular a structure for a building, by welding, in particular relates to a fire-resistant steel having a high yield stress at 600° C. and simultaneously superior in SR (stress relief) crack resistance (reheat embrittlement resistance) and toughness of the weld joint and a method of production of the same.

BACKGROUND ART

In a welded structure forming a building structure, it goes without saying that the weld joint characteristics have to be superior. In recent years, possession of superior tensile strength at a high temperature, the characteristic of so-called "fire-resistant steel" (fire-resistant performance), has become sought.

This is a characteristic decided on by the Japanese Ministry of Land, Infrastructure, Transportation, and Tourism based on the "New Fire-Resistant Design Law" enabling use of steel materials without fire-resistant coverings considering environmental issues and is based on the performance based on MLIT Notification No. 333 (2004).

Here, "fire-resistant performance" is the performance required for enabling a steel material to continue to exhibit the necessary strength for a certain time when a steel material is exposed to a fire in an uncovered state and facilitating the escape of residents by preventing the building structure from collapsing during that time.

When a steel material is not provided with a fire resistant covering, various sizes of fires and ambient temperatures at the time of fires may be envisioned, so the high temperature strength required for a steel material supporting the strength of a structure is required to be as high as possible.

Steel materials provided with such fire-resistant performance have long been the subject of R&D in all different fields.

For example, disclosures of inventions relating to steel materials containing Mo and high in high temperature strength may be found in (a) Japanese Patent Publication (A) No. 2001-294984, (b) Japanese Patent Publication (A) No. 10-096024, and (c) Japanese Patent Publication (A) No. 2002-115022.

The arts disclosed in these PLT's a to c all relate to materials raised in high temperature strength by precipitation strengthening by Mo carbides or precipitation strengthening by other carbides plus texture strengthening so as to raise the high temperature strength.

On the other hand, due to the pinch in supply and demand of various types of alloy elements, industrially speaking the addition of Mo ends up raising the costs of the steel materials. Due to this reason, disclosures of arts employing other alloy designs have been seen.

In particular, the example of the invention described in (d) Japanese Patent Publication (A) No. 07-286233 adding B to improve the quenchability so as to secure high temperature strength aiming at a 600° C. or so temperature, the example of the invention described in (e) Japanese Patent No. 3635208 adding γ-phase stabilizing elements of Cu, Mn, etc., etc. may be mentioned.

However, when unintentionally adding γ-phase stabilizing elements such as in the PLT e or adding B for the purpose of suppressing formation and growth of nuclei from the grain boundaries to form a low temperature transformed structure such as in the PLT d, there is the problem that remarkable embrittlement occurs when the grain boundaries of the steel material are exposed to a high temperature (phenomenon of ductility being impaired at the time of high temperature deformation, called "reheat embrittlement").

According to research of the inventors, in such a steel material, no matter how high the high temperature strength, there is almost no high temperature deformation ability, so it became clear that when designing deformation of the structure so to be borne concentratedly at the weld joints or when breakage occurs, mainly the HAZ (heat affected zone) and the grain boundaries at the HAZ side near the borders with the weld metal cannot keep up with deformation at the time of a high temperature of a fire and grain boundary breakage occurs in some cases.

The above-mentioned embrittlement phenomenon (reheat embrittlement phenomenon) mainly includes cases of embrittlement due to grain boundary precipitation and cases of segregation causing only the grain boundaries to drop in transformation point, the strength of the grain boundary parts remarkably dropping and local deformation occurring, and as a result breakage such as peeling from the grain boundaries occurring. It changes in various ways depending on the chemical ingredients of the steel materials. This was clarified by research of the inventors.

In the above way, when a steel material is exposed to a high temperature and is held at a temperature near 600° C. at the time of a fire, embrittlement of the grain boundaries occurring near the weld metal of an HAZ (drop in ductility at time of high temperature deformation) sometimes may lead to difficult-to-predict major deformation occurring along with unstable breakage modes at the weld joint even when the base material part of a steel structure raised in high temperature strength is sound.

For this reason, design of the structure becomes difficult. As a result, even if a steel material has sufficient high temperature strength, the fire resistant structure will clearly become an unsuitable structure.

None of the conventional fire-resistant steels described in the above PLT's a to c were designed in alloys considering the grain boundary embrittlement at the time of reheating the HAZ (that is, at the time of fire). They only give findings regarding the alloy design when focusing only on high temperature strength, in particular high temperature tensile strength.

Such conventional fire-resistant steels have Mo or B added for the purpose of improving the high temperature strength. On this point, they are based on elements with high abilities to form Mo carbides or B nitrides precipitating at the grain boundaries at 600° C. temperature.

On the other hand, the above-mentioned reheat embrittlement phenomenon is not manifested simply by just precipitation embrittlement. This phenomenon was first clarified as a result of the research of the inventors and is a new problem to be solved.

In the past, in the field of heat resistant steel, it was known that the reheat embrittlement was lightened by adding Cr to 2% or more and, further, that with an amount of addition of 0.5% or less, reheat embrittlement did not easily occur.

If gradually adding Cr to a steel material not containing Cr and the amount of addition exceeds 0.5%, the structure easily transforms to bainite and the material strength is improved. This is a result of improvement of the quenchability. At the same time, however, a bainite structure has old γ-grain boundaries clearly remaining at it, so at the old γ-grain boundaries, embrittlement easily is manifested and reheat embrittlement becomes easier.

On the other hand, if adding 2% or more of Cr, ordinary carbides, for example, cementite, become unstable, $Cr_{23}C_6$ carbides are formed, and other carbides, for example, $Mo_2C$, are similarly robbed of carbon by Cr, and coarsening becomes more difficult at the grain boundaries. Due to this, it had been thought that grain boundary embrittlement could be prevented, but on the other hand $Cr_{23}C_6$ carbides also easily precipitated at the grain boundaries.

In this way, while many hypotheses like the above have been proposed, no final interpretation regarding the relationship between the amount of addition of Cr and reheat embrittlement has yet been established.

Under such current circumstances, the inventors etc. engaged in intensive research. As a result, they discovered that the reheat embrittlement phenomenon is related to the transformation point of the steel material.

That is, the addition of Cr has the effect of raising the transformation point of the steel material and simultaneously consuming the solid solution C to raise the transformation point. On the other hand, adding larger amounts of Ni and Mn known as γ-stabilizing elements lowers the transformation point. For this reason, it was discovered that when carbon etc. concentrates at the grain boundaries, at the high temperature region covered by the present invention, that is, at a 600° C. temperature, the transformation point and the high temperature yield strength evaluation temperature approach each other, part of the grain boundaries undergo $\alpha \rightarrow \gamma$ transformation to be already changed in phase, numerous dislocations are lost from the structure at the time of change of arrangement of the atoms, and the strength remarkably falls, whereby breakage occurs from the grain boundaries.

As a result, raising the transformation point of the steel material is essential. Simultaneously, addition of a large amount of elements high in affinity with carbon and easily precipitating at the grain boundaries is effective in the point of raising the high temperature strength, but simultaneously the sensitivity of the HAZ to reheat embrittlement ends up being raised and the design of the structure is made more difficult. This became clear as a new problem.

Still further, in recent years, buildings have been built larger in size and higher in number of stories for the purpose of efficient utilization of land, but this larger size of structures invites an increase in size of the building materials, that is, steel plates, steel shapes, or steel pipes. To improve the efficiency of production of these steel products or improve the efficiency of assembly, the heat input at the time of welding tends to be made higher. For this reason, to obtain sufficient earthquake resistance even when the weld heat input is high, it was necessary to obtain sufficiently high weld zone toughness.

DISCLOSURE OF INVENTION

The present invention was made in consideration of the problems of such conventional fire-resistant steel. It has as its object to provide fire-resistant steel superior in weld joint reheat embrittlement resistance and toughness obtaining high temperature strength and simultaneously establishing weld joint reheat embrittlement resistance, a problem which the above-mentioned conventional steel had difficulty in solving, and a method of production of the same.

The inventors engaged in intensive research to solve the above problems and identified as the most important issues in the present invention the optimization of the chemical ingredients of the steel material so as to satisfy at least ½ of the prescribed strength at room temperature at the 600° C. assumed fire temperature and simultaneously realization of fire-resistant steel having a sufficient toughness at 0° C. temperature at the bond of the weld joint (boundary part of HAZ and weld metal, the part also called the "fusion line") and provided with reheat embrittlement resistance at the time of reheating at the time of a fire.

As already explained, to obtain high temperature strength, first, it is necessary to introduce dislocations governing the strength of the material. For this reason, the inventors added the Mn and Cr in the necessary amounts, did not add Mn in excess, and limited the addition of other γ-stabilizing elements of Ni and Cu and in addition basically did not add B to prevent formation of BN susceptible to grain boundary embrittlement. Furthermore, they suppressed the amount of addition of Mo to 0.1% or less to suppress coarse grain boundary precipitation of Mo carbides and thereby obtained reheat embrittlement resistance.

For this reason, as a specific indicator, they introduced the SRS value defined by the following formula $$[SRS]=4Cr[\%]-5Mo[\%]-10Ni[\%]-2Cu[\%]-Mn[\%]$$

and used the numerical value to quantitatively limit the alloy design indicators.

Further, in a large heat-input weld zone where 5 kJ/mm or more heat input is added to the HAZ, to reliably obtain a sufficient toughness of the boundary part of the HAZ and the weld metal, that is, sufficient toughness of the bond, the inventors limited the amount of C to less than 0.05% to control it lower than ordinary steel materials and further controlled it to add 0.01% as the minimum limit of the amount of addition of C. At the same time, they concluded that by suitably selecting the amounts of addition of alloy elements in the ranges prescribed by the present invention, it is possible to optimize the composition of chemical ingredients to achieve both high temperature strength and large heat input HAZ toughness.

Note that, superior high temperature strength cannot be obtained by the method of usual rolling and passive cooling of the steel materials of the present invention. This is because the amounts of alloy elements are limited to obtain the above-mentioned bond toughness, so the quenchability is not sufficient.

The fact that controlled cooling may be used to complement the strength to deal with this problem became clear by research of the inventors. That is, the inventors discovered that by using the method such as the following 1) or 2), it is possible to realize expression of strength at a high temperature together with the precipitation strengthening at a high temperature.

1) The method of hot rolling during which setting a sufficient rolling reduction ratio, making the cast structure homogeneous, ending the rolling at a 800° C. or higher high temperature, then cooling different parts of steel plate by a 2° C./s or more cooling speed by controlled cooling, continuing this cooling until a 100° C. or less temperature so as to once obtain a bainite structure and then quenching to improve the room temperature strength and simultaneously keep the room temperature yield strength low or the method of next tempering to optimize the strength and toughness in a combination of controlled cooling and tempering.

2) The method of similarly ending the rolling at 800° C. or more temperature, then similarly cooling the different parts of the steel plate by a 2° C./s or more cooling speed, stopping the controlled cooling in a 400 to 750° C. temperature range, then passively cooling the plate to thereby obtain the same effect as tempering in the middle of cooling down to room temperature for controlled cooling of a midway stopping type or the method of further after this tempering by heat treatment to reliably improve the steel material strength and the precipitation density of carbides or nitrides and thereby obtain steel plate substantially 20% or more comprised of a bainite or tempered bainite structure.

Here, the required high temperature strength explained in the present invention (high temperature yield strength) in principle means ½ of the prescribed yield strength at room temperature. For example, when there is a range in yield strength of the steel material prescribed by the JIS standard etc., ½ of the lower limit value is made the required yield strength.

Therefore, the required high temperature yield strength changes in accordance with the room temperature strength. With tensile strength 400N/mm$^2$ class steel, it becomes ½ of the lower limit value of the room temperature yield strength of 235N/mm$^2$, that is, 117N/mm$^2$ (fraction rounded down), while with tensile strength 500N/mm$^2$ class steel, it becomes ½ of the room temperature yield strength of 325N/mm$^2$, that is, 162N/mm$^2$.

These provisions of the present invention are not necessarily stipulated in actual industrial standards and are values estimated from design calculations. They are guidelines including safety margins. Lower limits are set for each, but there are no upper limit values.

The gist of the present invention made based on the results of the above studies is as follows:

[1] A fire-resistant steel superior in weld joint reheat embrittlement resistance and toughness comprising a fire-resistant steel of a room temperature strength of the 400 to 600N/mm$^2$ class having steel ingredients containing, by mass %, C: 0.010% to less than 0.05%, Si: 0.01 to 0.50%, Mn: 0.80 to 2.00%, Cr: 0.50% to less than 2.00%, V: 0.03 to 0.30%, Nb: 0.01 to 0.10%, N: 0.001 to 0.010%, and Al: 0.005 to 0.10%, limiting contents of Ni, Cu, Mo, and B to Ni: less than 0.10%, Cu: less than 0.10%, Mo: 0.10% or less, and B: less than 0.0003%, further limiting contents of impurity ingredients of P, S, and O to P: less than 0.020%, S: less than 0.0050%, and O: less than 0.010%, having a balance of iron and unavoidable impurities, wherein among the elements forming the steel ingredients, the elements of Cr, Mo, Ni, Cu, and Mn satisfy a relationship expressed by the following formula (1):

$$4Cr[\%]-5Mo[\%]-10Ni[\%]-2Cu[\%]-Mn[\%]>0 \quad (1)$$

{where, in formula (1), the units of the concentrations of the elements are made mass %}

[2] A fire-resistant steel superior in weld joint reheat embrittlement resistance and toughness as set forth in the above [1], further containing, by mass %, one or both of Ti: over 0.005% to less than 0.050% and Zr: 0.002 to 0.010%.

[3] A fire-resistant steel superior in weld joint reheat embrittlement resistance and toughness as set forth in the above [1] or [2], further containing, by mass %, one or more of Mg: 0.0005 to 0.005%, Ca: 0.0005 to 0.005%, Y: 0.001 to 0.050%, La: 0.001 to 0.050%, and Ce: 0.001 to 0.050%.

[4] A fire-resistant steel superior in weld joint reheat embrittlement resistance and toughness as set forth in any one of the above [1] to [3], where, furthermore, a dislocation density in a ferrite phase of the steel material is $10^{10}$/m$^2$ or more.

[5] A fire-resistant steel superior in weld joint reheat embrittlement resistance and toughness as set forth in any one of the above [1] to [4], wherein the steel material structure is given an occupancy of bainite or martensite in a structure viewed under an optical microscope of 20% or more and is comprised of a quenched structure.

[6] A fire-resistant steel superior in weld joint reheat embrittlement resistance and toughness as set forth in any one of the above [1] to [5], wherein, in the steel material, carbides or nitrides comprised of one or more of Nb, V, Cr, Ti, and Zr are precipitated by a 2/μm$^2$ or higher density.

[7] A method of production of fire-resistant steel superior in reheat embrittlement resistance and toughness comprising heating a steel slab having steel ingredients as set forth in any one of the above [1] to [3] to a 1150 to 1300° C. temperature, then hot working or hot rolling it, ending the hot working or hot rolling at a 800° C. or higher temperature, after this, acceleratedly cooling until down to a temperature of 500° C. so that the cooling speed of the different parts of the steel material becomes 2° C./sec or more, stopping the accelerated cooling in the temperature region where the surface temperature of the steel material becomes 350 to 600° C., and, after this, passively cooling the material.

[8] A method of production of fire-resistant steel superior in reheat embrittlement resistance and toughness comprising heating a steel slab having steel ingredients as set forth in any one of the above [1] to [3] to a 1150 to 1300° C. temperature, then hot working or hot rolling it, ending the hot working or hot rolling at a 800° C. or higher temperature, after this, acceleratedly cooling until down to a temperature of 500° C. so that the cooling speed of the different parts of the steel material becomes 2° C./sec or more, stopping the accelerated cooling in the temperature region where the surface temperature of the steel material becomes 100° C. to room temperature, and, after this, passively cooling the material to thereby obtain a quenched structure wherein, in the steel material structure, an occupancy of bainite or martensite in the structure viewed under an optical microscope becomes 20% or more.

[9] A method of production of fire-resistant steel superior in reheat embrittlement resistance and toughness comprising applying the method of production as set forth in the above [7] or [8], then tempering the steel material in a 400° C. to 750° C. temperature range for within 5 minutes to 360 minutes of time so as to make carbides or nitrides comprised of one or more of Nb, V, Cr, Ti, and Zr precipitate in the steel material by a 2/μm$^2$ or higher density.

According to the fire-resistant steel of this present invention, the strength at a 600° C. temperature, in particular the tensile yield strength, is at least ½ of the time of room temperature, the HAZ bond will not undergo reheat embrittlement even at the assumed fire temperature, and a bond toughness of the large heat-input weld zone of 5 kJ/mm or more can be simultaneously obtained.

Further, according to the method of production of the fire-resistant steel of the present invention, it is possible to produce fire-resistant steel where the strength at a 600° C. temperature, in particular the tensile yield strength, is at least ½ of the time of room temperature, the HAZ bond will not undergo reheat embrittlement even at the assumed fire temperature, and a bond toughness of the large heat-input weld zone of 5 kJ/mm or more can be simultaneously obtained.

Therefore, according to the present invention, provision of fire-resistant steel for building use superior in high temperature strength and superior in reheat embrittlement resistance and toughness of the weld joint becomes possible.

Note that, the high temperature yield strength changes for each temperature due to the composition of the steel material. At a 700° C. or higher temperature, a steel material superior in high temperature yield strength cannot necessarily exhibit the high temperature yield strength high at less than 700° C. temperature. This is because, when a material is exposed to the environment of a fire, at what temperature region the precipitation of carbides etc. contained in advance as alloy ingredients (called "secondary hardening") occurs at greatly affects the high temperature yield strength. The present invention newly proposes a steel material for obtaining a superior high temperature yield strength at 600° C. and is based on a design idea different from steel materials superior in high temperature yield strength in other temperature regions

BEST MODE FOR CARRYING OUT THE INVENTION

Figure 1:
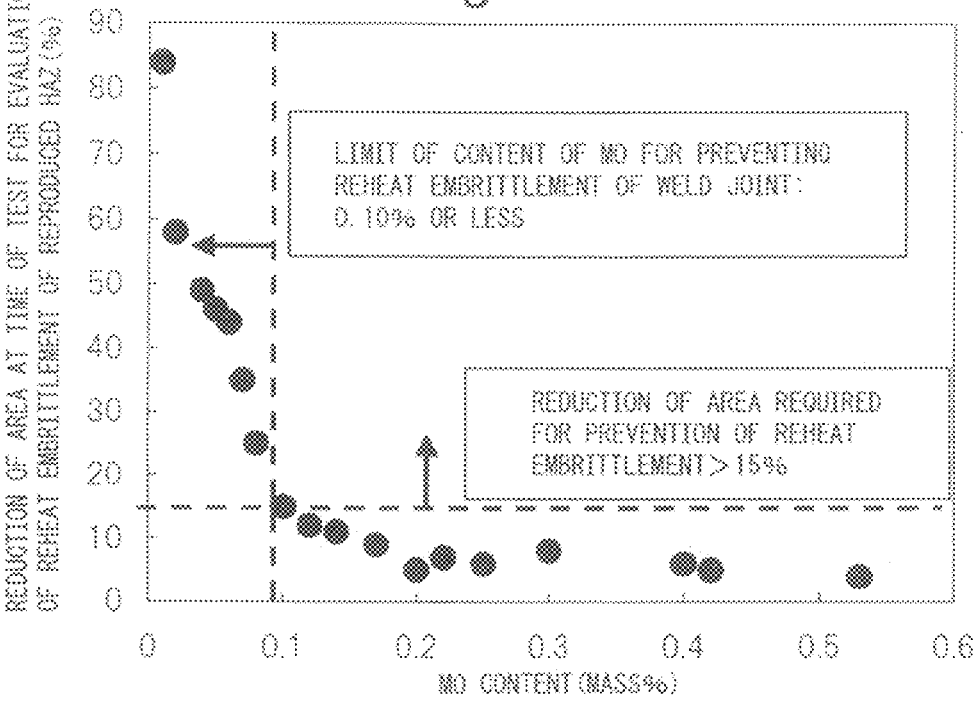
FIG. 1 is a view schematically explaining an example of fire-resistant steel according to the present invention and is a graph showing the relationship between the Mo content and the reduction of area (SR reduction of area) of a weld joint at the time of a tensile test of the reproduced HAZ at 600° C.

Below, an embodiment of the fire-resistant steel of the present invention superior in weld joint reheat embrittlement resistance and toughness and a method of production of the same will be explained. Note that, this embodiment is explained in detail for enabling the gist of the invention to be understood better, so unless particularly specified, does not limit the present invention.

The fire-resistant steel superior in weld joint reheat embrittlement resistance and toughness according to the present invention comprises a fire-resistant steel of a room temperature strength of the 400 to 600N/mm$^2$ class having steel ingredients containing, by mass %, C: 0.010% to less than 0.05%, Si: 0.01 to 0.50%, Mn: 0.80 to 2.00%, Cr: 0.50% to less than 2.00%, V: 0.03 to 0.30%, Nb: 0.01 to 0.10%, N: 0.001 to 0.010%, and Al: 0.005 to 0.10%, limiting contents of Ni, Cu, Mo, and B to Ni: less than 0.10%, Cu: less than 0.10%, Mo: 0.10% or less, and B: less than 0.0003%, further limiting contents of impurity ingredients of P, S, and O to P: less than 0.020%, S: less than 0.0050%, and O: less than 0.010%, and having a balance of iron and unavoidable impurities, wherein among the elements forming the steel ingredients, the elements of Cr, Mo, Ni, Cu, and Mn satisfy a relationship expressed by the following formula (1):

$$4Cr[\%]-5Mo[\%]-10Ni[\%]-2Cu[\%]-Mn[\%]>0 \quad (1)$$

{where, in formula (1), the units of the concentrations of the elements are made mass %}

[Steel Ingredients of Fire-Resistant steel (Composition of Chemical Ingredients)]

First, the reasons for limitation of the ranges of basic chemical ingredients of the steel prescribed for working the present invention will be explained. Note that, in the following explanation, the amounts of addition of the different elements are all expressed by mass %.

C: 0.010% to less than 0.05%

C is an element effective for improvement of the quenchability of a steel material and is an element essential for simultaneously forming carbides. In a steel material, at the minimum, to cause the precipitation of carbides stable at a 600° C. temperature, C has to be added at 0.010% or more. Further, if adding C to 0.05% or more, at a large heat-input weld HAZ, a large amount of residual austenite or precipitated carbides is formed and the bond toughness is made to remarkably deteriorate at the HAZ. Therefore, the range of addition was defined as 0.010% to less than 0.05%. If considering the case where the weld heat input becomes further larger, the smaller the C content the better. C may be limited to 0.015% or more or 0.020% or more. Further, to improve the bond toughness, C may be limited to 0.040% or less.

Si: 0.01 to 0.50%

Si is a deoxidizing element and is an element contributing to the improvement of the quenchability as well, but unless at least 0.01% or more is added, the effect will not be expressed. On the other hand, if adding Si to over 0.50%, since Si is an element raising the stability of the residual austenite, in particular lowering the toughness of the HAZ, the range of addition was defined as 0.01 to 0.50%. To perform the deoxidation more reliably, Si may also be limited to 0.05% or more, 0.10% or more, or 0.15% or more. Further, to improve the toughness of the HAZ, the content may be limited to 0.45% or less or 0.40% or less.

Mn: 0.80% or more to 2.00%

Mn is a γ-phase stabilizing element. It contributes to the improvement of the quenchability, but in a steel material containing Cr like in the present invention, if not adding Mn to 0.80% or more, the effect is liable not to be expressed. Further, if adding over 2.0% of Mn, the Ac1 transformation point drops remarkably. At the time of reheating to 600° C., at the HAZ accompanying grain boundary segregation, at the time of reheating, local α→γ-transformation occurs and a remarkable drop in grain boundary strength is caused. Further, the grain boundary precipitation of carbides is promoted whereby precipitation embrittlement occurs. Also, the reheat embrittlement resistance, judged by the reduction of area at the time of a high temperature tensile test of a structure corresponding to the reproduced heat cycle HAZ, ends up becoming 15% or less. Therefore, the range of addition was limited to 0.80 to 2.0%. To more actively utilize the quenchability effect of Mn, Mn may be limited to 0.90% or more, 1.05% or more, or 1.20% or more. Further, to prevent a drop in the Ac1 transformation point etc., it may be limited to 1.80% or less or 1.60% or less.

Cr: 0.50% to less than 2.00%

Cr, when added to 0.50% or more, has the effect of raising the quenchability of the steel material. Further, it also has affinity with carbon and has the effect of suppressing the coarsening of elements with extremely high affinity with C such as Nb, V, or Ti. In addition, it exhibits the remarkable effect of changing the phase of the phase diagram itself from an iron-carbon-based eutectic type to the γ-loop type and raising the transformation point in particular at the grain boundaries. However, if over 2.00% of Cr is added, there is no particular problem in the steel material characteristics, but there are issues in steelmaking, that is, due to the lengthening of the impurity-removal time, the molten steel temperature ends up falling during refining, the castability is degraded, and in turn a rise in cost at the time of production is invited, so the upper limit of addition was limited to 2.00%. Note that, in the present invention, when adding a large amount of V or Si, the amount of addition of Cr more preferably has to be controlled to 0.50 to 1.50%. However, the addition of Cr sometimes lowers the molten steel temperature at the time of steelmaking and refining, so to keep down the rise in costs, Cr may be limited to 1.80% or less, 1.50% or less, or 1.40% or less. Further, to raise the quenchability, Cr may be limited to 0.75% or more or 1.00% or more.

V: 0.03 to 0.30%

V forms carbides easily finely dispersing in the grains and extremely effective for improvement of the high temperature yield strength. The effect appears with addition of 0.03% or more. Further, if adding over 0.30%, the grain boundary precipitation and coarsening become remarkable and the reheat embrittlement resistance is made worse, so the range of addition was limited to 0.03 to 0.30%. However, in the tempering process, V carbides tend to precipitate at the grain boundaries, so V may be limited to 0.25% or less or 0.20% or less. Further, to improve the high temperature yield strength, V may be limited to 0.05% or more or 0.08% or more.

Nb: 0.01 to 0.10%

Nb bonds with carbon in a short time to precipitate as NbC and contributes to the improvement of the strength at room temperature and high temperature strength. Simultaneously, it remarkably raises the quenchability of the steel material, contributes to the improvement of the dislocation density, and improves the effect of improvement of the strength of the steel materials due to controlled cooling. However, if the amount of addition of Nb is less than 0.01%, the effect is not seen. Further, if added over 0.10%, NbC coarse precipitation occurs at the grain boundaries, reheat embrittlement is caused, and unstable fracture of the weld joint at a high temperature is liable to be aggravated, so the range of addition was limited to 0.01 to 0.10%. To utilize the effect of improvement of strength by Nb better, Nb may be limited to 0.02% or more, 0.03% or more, or 0.04% or more. Further, to avoid reheat embrittlement, Nb may be limited to 0.08% or less or 0.06% or less.

N: 0.001 to 0.010%

N is not deliberately added in the present invention and is an element which should be controlled so that coarse nitrides are not formed. However, if N is added in a fine amount, since it is chemically stabler than carbides, it precipitates as nitrides and contributes to improvement of the high temperature yield strength in some cases. For this reason, the amount of addition of N is prescribed as 0.001% as an industrial limit. Further, as the upper limit of the amount of addition, 0.010% is prescribed to suppress formation of coarse nitrides. To improve the high temperature yield strength, N may be limited to 0.080% or less or 0.060% or less.

Al: 0.005 to 0.10%

Al is an element required for deoxidation of the steel material and for making the grain size smaller by formation of AlN. In particular, in a steel material containing Cr, it is added as a main deoxidizing element so as to prevent Cr from oxidizing during refining and becoming harder to add to the steel material. This effect of enabling control of the concentration of oxygen in molten steel by Al alone is obtained by adding 0.005% or more, so the lower limit value of Al was made 0.005%. On the other hand, if the Al content exceeds 0.10%, coarse oxide clusters are formed and the toughness of the steel material is sometimes impaired, so the upper limit value was defined as 0.10%. For more reliable deoxidation and grain refinement by formation of AlN, Al may be limited to 0.010% or more, 0.015% or more, or 0.020% or more. Further, to prevent a drop in the toughness of the steel material due to formation of coarse oxide clusters, Al may be limited to 0.08% or less or 0.06% or less.

Ni: less than 0.10%

Cu: less than 0.10%

Mo: 0.10% or less

B: less than 0.0003%

Ni, Cu, Mo, and B are all effective for improving the quenchability, but are limited in content as explained below.

Ni and Cu, as already explained, are elements which cause the Ac1 transformation point to remarkably drop and give the possibility of promoting reheat embrittlement by local transformation at the grain boundaries. For this reason, these elements, even if included in impurities, have to be removed or the refining step has to be devised to prevent entry. The allowable upper limit is in each case 0.10%, so the limit of content was defined as less than 0.10% considering a safety margin in industrial production.

In the same way, from the viewpoint of preventing reheat embrittlement of the weld zone after a fire, inclusion of Mo and B is not preferable. Even entry as impurities has to be avoided, so the inventors clarified the strict limits on content through experiments.

FIG. 1 is a graph showing the reduction of area at the time of a 600° C. high temperature tensile test of the structure corresponding to the reproduced heat cycle HAZ for evaluating the addition of Mo to the invention steel material and how its content affects the reheat embrittlement resistance at the time of assumed fire reheating. Here, when the reduction of area is 15% or less, clear grain boundary breakage can be observed at half or more of the fracture face. It can be judged that the reheat embrittlement resistance is degraded.

Specifically, the reproduced HAZ prepared by giving a reproduced HAZ heat cycle assuming a weld heat input of 2 kJ/mm (heating to a 1400° C. temperature by 150° C./sec, holding for 2 seconds, then passing from a temperature range from 800° C. to 500° C. in about 16 seconds) was raised from room temperature to the assumed fire temperature of 600° C. temperature over 1 hour and held for 30 minutes, then stress was applied to the test piece by hydraulic pressure and the stress increased until the test piece broke as a test (below, called "SR reduction area test"). As a result of the test, the fracture face of a broken test piece was observed and the reduction of area expressed by the value of the area of the fracture face divided by the cross-sectional area of the parallel part of the test piece before the test (0 to 100%: below, sometimes abbreviated as the "SR reduction of area") was evaluated.

From the graph of FIG. 1, it is learned that if adding Mo over 0.10%, the reduction of area becomes 15% or less. Further, at the fracture face where the SR reduction of area was 15% or less, grain boundary cracks were confirmed at over half of the fracture face.

Figure 2:
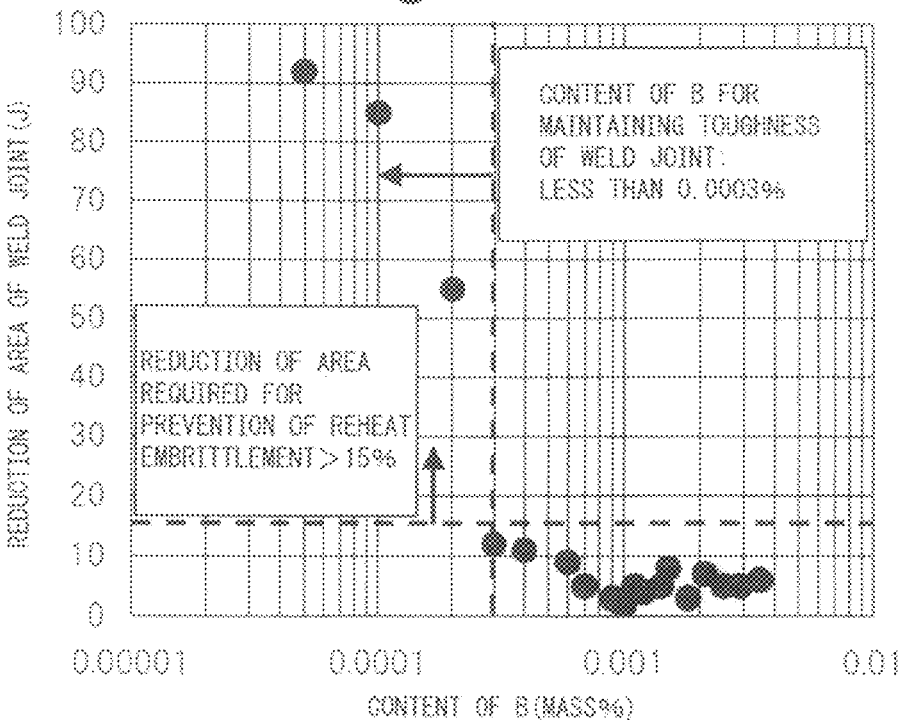
FIG. 2 is a view schematically explaining an example of fire-resistant steel according to the present invention and is a graph showing the relationship between the B content and the reduction of area (SR reduction of area) of a weld joint at the time of a tensile test of the reproduced HAZ at 600° C.

Further, in the same way, the relationship of the SR reduction of area at 600° C. when adding B to the steel material of the present invention is shown in the graph of FIG. 2. It is learned that due to the slight 0.0003% addition, B reduces the SR reduction of area to 15% or less.

Based on the results of the experiments, the limits of Mo: 0.10% or less and B: less than 0.0003% were defined. Due to this provision, it becomes possible to prevent reheat embrittlement of the weld joint.

To sufficiently obtain the effect of the present invention, it is necessary to sufficiently take care of the entry of B. It is necessary to strictly control the amount of addition of B to less than 0.0003% including entry from the raw materials of scrap, ore, or alloy materials or contamination from furnace materials etc. When able to strictly select the steelmaking materials, the allowable upper limit value of B, if considering the fluctuation in analysis values in industry, is less than 0.0002%.

Note that, to reliably make the indicator for evaluation of the reheat embrittlement resistance, that is, the SR reduction of area, over 15%, in the present invention, the SRS value expressed by the following formula {[SRS]=4Cr[%]-5Mo[%]-10Ni[%]-2Cu[%]-Mn[%]} (corresponding to the above (1) formula) was used to define the composition of chemical ingredients.

This [SRS] formula, as already stated, analyzes the ranges of chemical ingredients where no local softening of grain boundaries occurs due to partial transformation of the grain boundaries at a high temperature due to the prevention of grain boundary precipitation embrittlement and Ni, Cu, and Mn γ-phase stabilizing elements by multiple regression analysis using the experimental results, linearly approximates the limit region making the SR reduction of area more than 15%, and rounds off the coefficient to a substantially whole value.

Further, in the [SRS] formula, it is necessary that the relationship {[SRS]>0} stand. It is only by satisfying both the provision of this formula and the provision of the composition of chemical ingredients of the present invention that reheat embrittlement prevention can be reliably realized.

Figure 4:
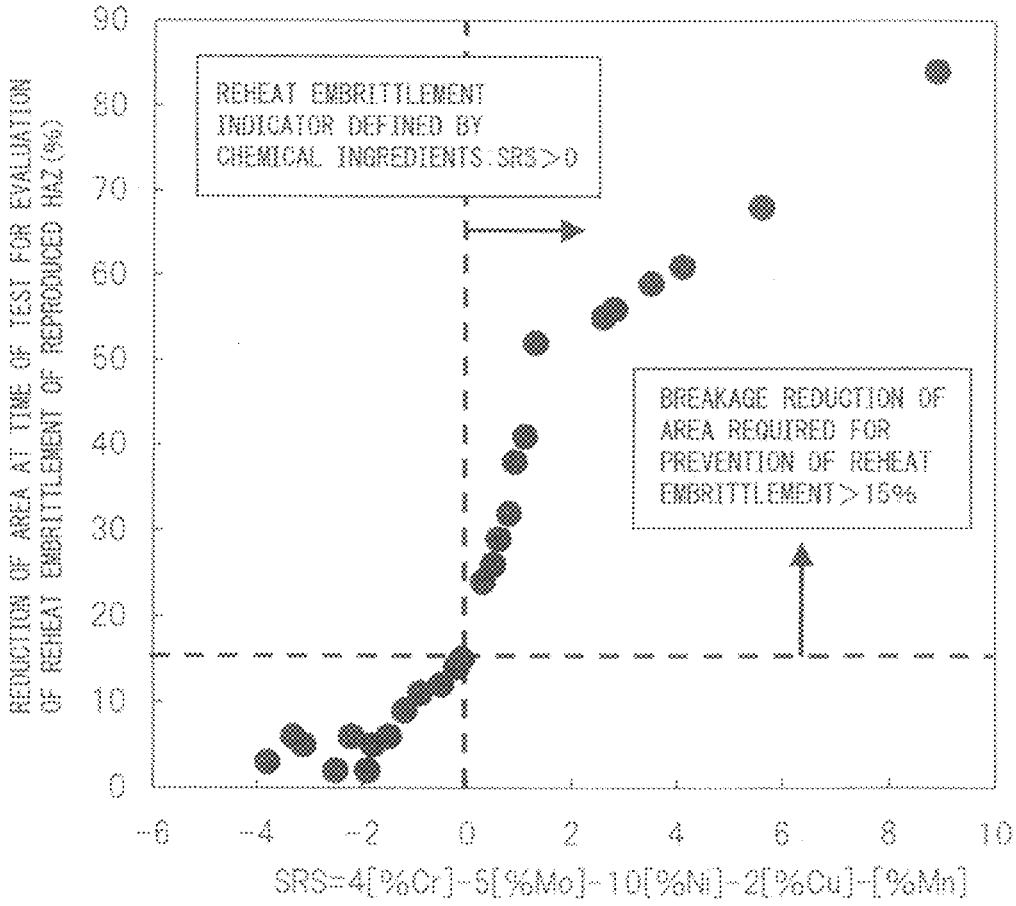
FIG. 4 is a view schematically explaining an example of fire-resistant steel according to the present invention and is a graph showing the relationship between a reheat embrittlement resistance indicator value SRS and a reduction of area at the time of a test for evaluation of the reheat embrittlement resistance of a reproduced HAZ.

FIG. 4 is a graph showing the relationship between the results of experiments conducted when defining the SRS values, that is, the SRS values of steel materials differing in SR reduction of area, and the border of an SR reduction of area of 15%. Based on this graph, the coefficient of the [SRS] formula was determined by the above method.

In the present invention, due to the correlation of Mo, Ni, and Cu entering as impurities and the intentionally added Mn and Cr, even if within the prescribed chemical ingredients, the SR reduction of area at the time of an SR reduction area test sometimes falls slightly below 15%. To prevent this, this was defined by the [SRS] formula.

For example, when containing Ni, Cu, and Mo at their respective upper limit values of 0.1%, even if the amount of Mn is made 1.8%, SRS becomes negative when Cr is 0.8%. In this case, precipitation embrittlement and local softening simultaneously occur and reheat embrittlement cannot be prevented. Conversely, when adding Cr in 1.5%, reheat embrittlement can be prevented even if adding other elements to the upper limit values.

In this way, the present invention does not show a steel material able to completely prevent reheat embrittlement by just limitation of the composition of chemical ingredients, but adds indicators for the optimization of chemical ingredients forming the [SRS] formula (corresponding to (1) formula of claim 1) and defines the ranges of alloy ingredients for suppressing reheat embrittlement.

P: less than 0.020%

S: less than 0.0050%

O: less than 0.010%

P, S, and O have enormous effects on the toughness of the steel material itself as impurities and also affect the reheat embrittlement at the time of a fire, so were limited to, as upper limits of content confirmed experimentally, P: less than 0.020%, S: less than 0.0050%, and O: less than 0.010%. For better improvement of toughness, it is also possible to limit P to less than 0.015% or less than 0.010%, S to less than 0.004% or less than 0.003%, and O to less than 0.0050% or less than 0.0030%.

By prescribing the steel ingredients as explained above, in the present invention, it is possible to realize a steel material superior in reheat embrittlement resistance of the weld joint of the steel material at the time of a fire, simultaneously superior in 5 kJ/mm large heat input HAZ toughness, and high in high temperature yield strength at a 600° C. temperature.

Next, the reasons for limitation of the range of addition of the optional elements in the present invention will be explained.

Ti: over 0.005% to 0.050%

Zr: 0.002 to 0.010%

Ti and Zr are carbide- and nitride-forming elements. By adding these, it is possible to use these for precipitation strengthening. In the present invention, to manifest the precipitation strengthening ability, Ti has to be added to over 0.005%. Further, if adding over 0.050%, coarse carbides precipitate at the grain boundaries and the reheat embrittlement resistance is degraded, so the range of addition was limited to over 0.005% to 0.050%. Further, Zr was limited to 0.002 to 0.010% for exactly the same reasons as Ti. It is possible to selectively add one or more of the above two optional elements.

Mg: 0.0005 to 0.005%

Ca: 0.0005 to 0.005%

Y: 0.001 to 0.050%

La: 0.001 to 0.050%

Ce: 0.001 to 0.050%

From the above-mentioned limitation of S and amount of addition of Mn, in the steel material of the present invention, the formation of MnS at the center segregated part is basically small, but at the time of mass production, cannot necessarily be completely eliminated. Therefore, to reduce the effect which sulfides have on the toughness of the steel material, addition of a sulfide-form controlling element becomes possible. Simultaneously, the effect of the present invention can be further improved.

That is, in the present invention, it is possible to select and include one or more of Mg: 0.0005 to 0.005%, Ca: 0.0005 to 0.005%, Y: 0.001% to 0.050%, La: 0.001% to 0.050%, and Ce: 0.001% to 0.050%.

If the amount of addition of any of these elements is less than the lower limit value, the effect is not expressed. Further, if the upper limit of addition is exceeded, coarse oxide clusters are formed and there is a possibility of unstable fracture of the steel material, so the elements were limited to the above ranges. Note that, Mg and Ca may be limited to 0.003% or less and Y, La, and Ce to 0.020% or less.

[Steel Material Structure]

In general, it is well known that along with the rise of the ambient temperature, the contribution of texture strengthening to the high temperature strength of a steel material is reduced. This is because along with the rise of the ambient temperature, structural recovery (promotion of phenomenon of merging and disappearance or dispersion accompanying rising motion of dislocations) progresses. For this reason, for expression of the high temperature strength, maintenance of the internal stress of a material at room temperature (deformation resistance of materials generally determined by governing mechanism among dislocation strengthening, precipitation strengthening, and other material strengthening factors) is important.

That is, first, the presence of factors introducing the amount of dislocations required for getting the material strength to be expressed in the steel material and preventing the dislocations from disappearing at a high temperature region, for example, high density immobile dislocations or precipitates dispersed in a high density, becomes important.

From this reason, in the present invention, in addition to the above provision of steel ingredients, it is more preferable to prescribe the steel material structure as follows.

(Dislocation Density)

In the fire-resistant steel of the present invention, preferably the dislocation density in the ferrite phase of the steel material is $10^{10}/m^2$ or more. If the dislocation density in the ferrite phase of the steel material is in this range, fire-resistant steel superior in high temperature strength characteristics is obtained.

The steel ingredients of the present invention (composition of chemical ingredients) is made the optimum composition for introducing precipitation strengthening factors preventing recovery of the dislocation structure so as to improve the reheat embrittlement resistance and not become causes of a drop in toughness at the HAZ receiving the heat effect of 5 kJ/mm large heat-input welding.

Therefore, in the state before the fire-resistant steel is exposed to a high temperature, that is, in the ordinary temperature environment before occurrence of a fire, it is necessary that dislocations be introduced so as to enable sufficient strength to be exhibited even at a high temperature.

In the present invention, for such a reason, the dislocation density in the ferrite phase of the steel material is defined as $10^{10}/m^2$ or more to realize superior high temperature strength characteristics (see also description of later explained method of production). If the dislocation density in the ferrite phase of the steel material is less than $10^{10}/m^2$, the effect becomes hard to obtain.

Here, as the method for measuring the dislocation density of a steel material, the method of evaluation from the half width of the X-ray diffraction peak (see following Reference Literature 1) may be used. Specifically, first, the test piece material was cut to 10 mm×10 mm×2 mm, then the main surface was polished to a mirror finish, then was chemically polished or electrolytically polished to remove the mirror polished surface to 50 μm or more. Further, this sample was placed in an X-ray diffraction system where its polished main surface was irradiated with Cr-$K_\alpha$ or Cu-$K_\alpha$ characteristic X-rays, and the back surface reflected X-ray diffraction method was used to measure the diffracted beams at the α-Fe(110), (211), and (220) faces. Cr-$K_\alpha$ or Cu-$K_\alpha$ characteristic X-rays are comprised of the neighboring $K_{\alpha1}$ rays and $K_{\alpha2}$ rays. For this reason, the method of Rachinger (see following Reference Literature 2) was used to subtract the close $K_{\alpha2}$ ray diffraction peak heights at the diffraction peaks of the crystal faces to evaluate the $K_{\alpha1}$ ray diffraction peak half width. This diffraction peak half width is proportional to the average strain $\epsilon$ in the crystal, so the Williamson-Hall method (see following Reference Literature 3) may be used to find $\epsilon$ from the diffraction peak half width.

Furthermore, from the average strain $\epsilon$, formula (10) $\{\rho=14.4\epsilon^2/b^2\}$ of the description of the following Reference Literature 1 (p. 396-399) is used to find the dislocation density ρ ($/m^2$). Here, "b" in the above formula is the size of Burgers vector ($=0.248\times10^{-9}$ m).

(1) Reference Literature 1: Koichi Nakajima et al., "Estimation of dislocation density by X-ray diffraction method", Current Advance in Materials and Process, Iron and Steel Institute of Japan, Vol. 17 (2004), No. 3, p. 396-399

(2) Reference Literature 2: Guinier, A., as translated by Kazutake Kohra et al., "Theory and Practice of X-ray Crystallography, Revised 3rd Edition", Rigaku Industrial (1967), p. 406

(3) Reference Literature 3: G. K. Williamson and W. H. Hall, Acta Metall., 1 (1953), p. 22

(Occupancy of Bainite or Martensite in Structure)

The fire-resistant steel of the present invention is preferably a quenched structure with an occupancy of bainite or martensite in the steel material structure of 20% or more. If the occupancy of bainite or martensite in the steel material structure is in this range, it becomes possible to obtain a steel material having the above prescribed dislocation density. If the occupancy of the bainite or martensite in the steel material structure is less than 20%, the above dislocation density in the ferrite phase of the steel material ($1010/m^2$ or more) is hard to obtain.

(Precipitation Density of Carbides or Nitrides)

The fire-resistant steel of the present invention preferably has carbides or nitrides of one or more of Nb, V, Cr, Ti, and Zr precipitated in the steel material at a $2/\mu m^2$ or more density. In the present invention, precipitates comprised of the above-mentioned carbides or nitrides and impairing movement of dislocations for expressing high temperature strength are precipitated in the steel material by the range of density and are interposed at dislocations in a suitably dispersed state, whereby the effect of improvement of the high temperature yield strength is reliably obtained. If the density of carbides or nitrides in the steel material is less than $2/\mu m^2$, it becomes possible to obtain the effect of improvement of the high temperature yield strength explained above.

[Method of Production of Fire-Resistant Steel]

Below, we will explain the reasons for limitation of the method of production of the fire-resistant steel superior in weld joint reheat embrittlement resistance and toughness of the present invention.

The method of production of fire-resistant steel superior in weld joint reheat embrittlement resistance and toughness according to the present invention comprises heating a steel slab having the above-explained steel ingredients to 1150 to 1300° C. in temperature, then hot working or hot rolling, ending the hot working or hot rolling at 800° C. or more temperature, after this, acceleratedly cooling the steel material until down to a temperature of 500° C. so that the cooling speed of the different parts of the steel material becomes 2° C./sec or more, stopping the accelerated cooling in the temperature region where the surface temperature of the steel material becomes 350 to 600° C., and, after this, passively cooling the material.

The present invention proposes steel ingredients (composition of chemical ingredients), but if just rolling such a steel material for production, the effects of the present invention cannot be stably obtained. This is because, the composition of chemical ingredients of the present invention is mainly prescribed focusing on the prevention of reheat embrittlement and acquisition of HAZ toughness and the specifications of the room temperature strength, yield ratio, and high temperature strength are sometimes not satisfied by just the prescribed range of composition of chemical ingredients.

As explained above, along with the rise in ambient temperature, the contribution of texture strengthening to the high temperature strength of a steel material is reduced, so to express high temperature strength, it is desired to maintain the internal stress of a material at room temperature. For this reason, the presence of factors introducing the amount of dislocations required for getting the material strength to be expressed in the steel material and preventing the dislocations from disappearing at a high temperature, for example, high density immobile dislocations or precipitates dispersed in a high density, becomes necessary.

The composition of chemical ingredients prescribed in the present invention is made the optimum composition for introducing precipitation strengthening factors so as to improve the reheat embrittlement resistance and not become causes of a drop in toughness at the HAZ receiving the heat effect of large heat-input welding. Therefore, in the state before the fire-resistant steel is exposed to a high temperature, that is, in an ordinary temperature environment before the occurrence of a fire, it is necessary that dislocations be introduced so as to enable sufficient strength to be exhibited even at a high temperature.

For this reason, adoption of the method of acceleratedly cooling the steel material to stabilize the overcooled state of the composition is suitable from an industrial viewpoint. However, industrially speaking, uniformly cooling steel plate of a thick plate thickness is not simple technology wise. It is necessary to use a uniform cooling mechanism of steel plate called "controlled cooling".

Here, when applying a steel material to an actual building structure, it is necessary to cut the produced steel plate to the desired shapes and create the component members, but from this viewpoint, but it is necessary that all locations of the steel material, that is, the different parts of the steel material as a whole, have similar structures.

The present invention stresses this point and makes the controlled cooling speed 2° C./s to obtain a sufficient dislocation density in the composition of chemical ingredients of the present invention of $10^{10}/m^2$ or more as a required condition.

Note that, unless maintaining the cooling speed at least at the bainite transformation start point (corresponding to Ar3 point at time of ferrite transformation) and, after this, making at least 20% or more of the cross-sectional structure a bainite structure or martensite structure, it is not possible to obtain the above dislocation density, so as a control indicator, the average cooling speed at the time of cooling from 800° C. to 500° C. was defined as 2° C./s.

This cooling can be continued until the Bs point where the bainite transformation completely ends (corresponding to $Ar_1$ point of ferrite transformation), but depending on the composition of chemical ingredients, the Bs point is sometimes 500° C. or more. It is not necessary to continuously perform water cooling until 500° C. The average cooling rate at the time of cooling from 800° C. to 500° C. limited as an indicator of the cooling speed is prescribed since in a steel material with a Bs point of 500° C. or more, a cooling speed of the Bs point or less is meaningless from the viewpoint of the improvement of the dislocation density.

Further, in the present invention, by stopping this controlled cooling process in the middle with the intention of eliminating the process, then naturally cooling it, it is also possible to improve the productivity of steel plate produced through a controlled cooling-tempering process.

Specifically, by stopping the cooling by a controlled cooling process in a temperature region of the surface temperature of the steel material of 350 to 600° C., then naturally cooling, while not completely the same, by adopting processes enabling substantially the same effect, that is, a process of controlled cooling-midway stopping and a process of passive cooling, it is possible to better improve the productivity.

Further, for the cooling by a controlled cooling process, a method of stopping at a temperature region from 100° C. to room temperature, then passively cooling is more preferable from the point of making at least 20% or more of the cross-sectional structure in the steel material structure a bainite structure or martensite structure and reliably obtaining a quenched structure.

On the other hand, there is also no problem with employing the conventional method of production of controlled cooling and tempering without going through such a high productivity process. Rather, in steel with a Bs transformation point of 500° C. or less and a relatively low quenchability, employing a controlled cooling-tempering process sometimes enables stable production from the viewpoint of the material characteristics.

Furthermore, when using controlled cooling for quenching to 100° C. or less and measuring the strength of the steel material, when the density of movable dislocations in the steel material is high, the yield stress apparently falls, the yield ratio falls below 0.8, and the characteristic called the "low YR (yield ratio)" can be obtained. The action which this characteristic gives is remarkable even when employing the above-mentioned controlled cooling-midway stopping process, but it is possible to further improve the effect.

Such a low YR steel material is low in plastic deformation start stress and high in tensile strength, so the material breaks after large deformation. Therefore, this can be suitably used as a material for a building strength superior in earthquake resistance.

Therefore, in the present invention, a process of production including controlled cooling down to 100° C. or less and not tempering can also be applied. This method is effective for stably obtaining earthquake resistance in a steel material.

Note that, the above-mentioned tempering after controlled cooling can be performed by suitably selecting and determining a temperature from 400 to 750° C. (temperature right under substantive Ac1 transformation point). It can be determined by the required material strength, state of precipitation of carbides, and the composition of chemical ingredients of the base material. It enables the effect of the present invention to be raised.

Further, the same is true for the heat treatment time. When the structural changes at the time of tempering are governed by dispersion of substances, the temperature and time can be interchanged as parameters giving the same effects. That is, equivalent processing can be performed by processing in a short time at a high temperature and in a long time at a low temperature.

Further, due to the tempering, precipitation of carbides is promoted. This effect is remarkable in high temperature strength. It enables the high temperature strength to be improved without changing the room temperature strength as discovered by the inventors experimentally.

Further, as the tempering after controlled cooling, tempering the steel material in a 400° C. to 750° C. temperature range for 5 minutes to within 360 minutes in time and causing carbides or nitrides comprised of one or more of Nb, V, Cr, Ti, and Zr to precipitate in the steel material by a $2/\mu m^2$ or more density as a condition are preferable in the point of enabling the high temperature strength of the fire-resistant steel to be improved more.

Figure 3:
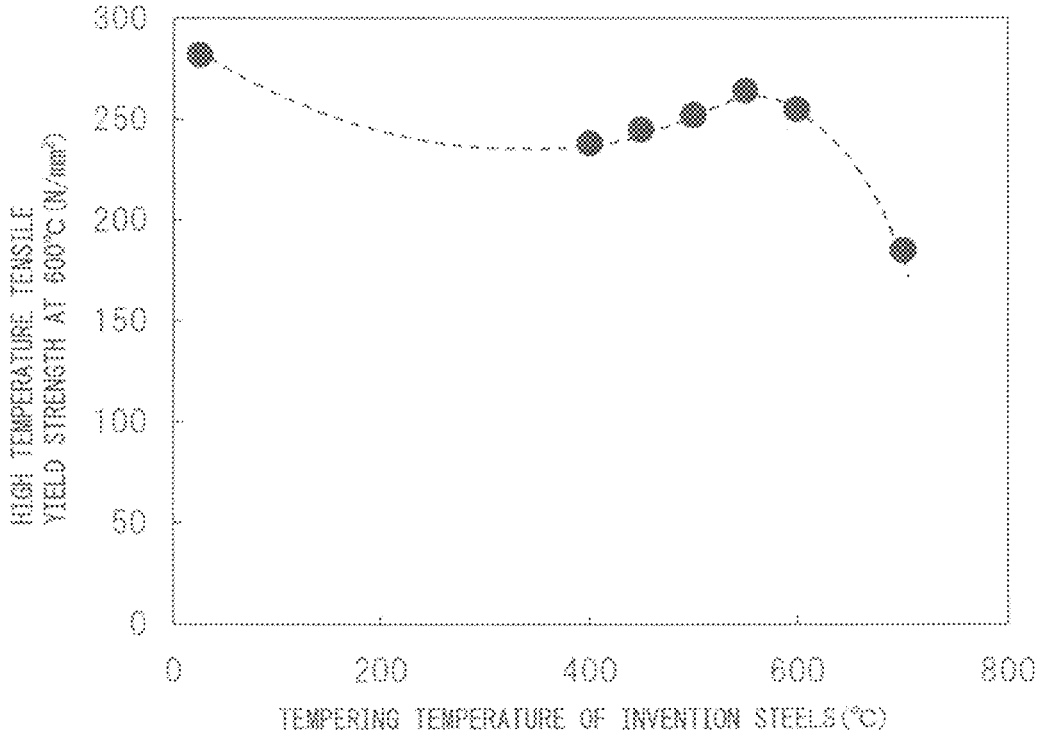
FIG. 3 is a view schematically explaining an example of a method of production of fire-resistant steel according to the present invention and is a graph showing the relationship between the tempering temperature and the 600° C. high temperature tensile yield strength when tempering the invention steels (stopping water-cooling midway).

FIG. 3 is a graph showing the results of producing, out of the invention steels described in claims 1 to 3, steels of the compositions of chemical ingredients described in Table 1 by controlled cooling-midway water cooling stop, then holding them at 400 to 700° C. for 0.5 hour, then again heating them to 600° C. and measuring the high temperature yield strength, as compared with the tempering temperature.

As shown in FIG. 3, it is learned that the high temperature yield strength exhibits its highest value at 550° C. It is learned that compared with non-tempered steel, the high temperature yield strength increases. At this time, when the required yield strength exceeds 162N/mm$^2$ (lowest value of strength specification in case of room temperature strength 500N/mm$^2$ class steel of ½ of 325N/mm$^2$), the precipitation of carbides in the steel material at a density of 2/μm$^2$ or more was confirmed by observation by a transmission type electron microscope by a magnification of 10,000×. This is the biggest feature of the present invention in terms of the effects of tempering.

Usually, tempering is performed for the purpose of reducing the room temperature strength, but in the present invention, it is learned that this has the effect of interposing the obstacles to movement of dislocations for expression of high temperature strength, that is, the precipitates, among dislocations in a suitable dispersed state and reliably enabling improvement of the high temperature yield strength. Therefore, the tempering conditions in the present invention are prescribed not only by adjustment of the room temperature strength like with conventional tempering, but also by control of the precipitation of carbides for improving the high temperature strength.

As explained above, according to the fire-resistant steel superior in weld joint reheat embrittlement resistance and toughness according to the present invention and its method of production, it is possible to provide a steel material having a strength at a 600° C. temperature, in particular a tensile yield strength, of ½ or more of that at the time of room temperature, having an HAZ bond free of reheat embrittlement even at the assumed fire temperature, and able to simultaneously obtain a 5 kJ/mm or higher bond toughness of the large heat-input weld zone and produce the same.

EXAMPLES

Below, examples of fire-resistant steel superior in weld joint reheat embrittlement resistance according to the present invention and its method of production will be given to explain the present invention more specifically, but the present invention is not of course limited to the following examples and can be worked while making suitable changes within a range complying with the gist of the invention explained before and later. These are also all included in the technical scope of the present invention.

[Preparation of Samples of Fire-Resistant Steel]

In the steelmaking process, the molten steel was controlled in deoxidation and desulfurization and chemical ingredients and continuously cast to prepare slabs of the composition of chemical ingredients shown in Table 2. Further, using the production conditions shown in Table 3, the slabs were reheated and rolled to thick plates to reduce them to predetermined plate thicknesses, then were heat treated under different conditions to produce samples of fire-resistant steel.

TABLE 1

(mass %)

| | Elements | | | | | | | | | | | | | | | | |
|---|---|---|---|---|---|---|---|---|---|---|---|---|---|---|---|---|---|
| | C | Si | Mn | Cr | P | S | Nb | V | Mo | Ni | Cu | Al | N | B | O | Ti | SRS |
| Content | 0.04 | 0.25 | 1.40 | 1.00 | 0.011 | 0.0012 | 0.02 | 0.08 | 0.01 | 0.06 | 0.02 | 0.015 | 0.004 | 0.0001 | 0.003 | 0.014 | 1.91 |

Note that, as art for reliably obtaining such a metal structure, the technique of controlling rolling and quenching the steel material is used, but specifically, as a method of production necessary and sufficient for introduction of dislocations into steel materials for expressing superior high temperature yield strength, it is necessary to ensure that the various high temperature stabilizing carbides, for example, NbC, VC, TiC, ZrC, and $Cr_{23}C_6$, completely enter solid solution by preheating to 1150° C. to 1300° C. in temperature, then forging or otherwise hot working the material or rough rolling or final rolling it or finishing (forging) it, then limiting the rolling (working) end temperature to 800° C. or more so as to raise the subsequent accelerated cooling start temperature as much as possible and raise the quenchability.

Further, at the time of rolling, it is necessary to eliminate the structures and recrystallize the steel at the time of casting as much as possible. For the purpose of pressing together small solidified voids etc., it is preferable to limit the rolling reduction ratio in hot working (in rolling, plate thickness before rolling divided by plate thickness after rolling, while in forging or other hot working, the reciprocal of the cumulative value of the provisional rates of change of the cross-sectional area) to 2.5 or more and ensure that a sound structure is obtained. This limitation is aimed at preventing segregation or voids resulting from uneven structure aggravating reheat embrittlement.

That is, in addition to the provisions of the composition of the chemical ingredients, if jointly using the provisions of the production conditions explained above, it becomes possible to produce fire-resistant steel superior in high temperature yield strength which has an extremely high yield and can optimize the amounts of addition of alloys.

Specifically, first, each slab was reheated at a 1160 to 1280° C. temperature for 1 hour, then immediately rough rolling was started to obtain 100 mm thick steel plate at 1050° C. temperature. Further, under the conditions shown in the following Table 3, this was rolled to thick-gauge steel plate of a final thickness of 15 to 35 mm or was forged or rolled to steel of a complicated cross-sectional shape of a maximum thickness of 15 to 35 mm and finish rolled while controlling the finishing temperature to 800° C. or more. Further, after the end of the rolling, the result was immediately acceleratedly cooled by water cooling targeting a 500° C. temperature. The surface temperature of the steel material in the temperature range of 500±50° C. at the different parts of the steel material was confirmed by the non-contact system or the method of attaching thermocouples to parts, stopping the accelerated cooling by water cooling, then allowing passive cooling to prepare samples of fire-resistant steel according to the present invention (claims 1 to 6) (invention steels: Steel Nos. 1 to 41).

Further, except for preparing slabs comprised of the steel ingredients shown in the following Table 4 and making the production conditions the conditions shown in the following Table 5, the same procedure as the invention steels was used to prepare samples of fire-resistant steels of comparative examples (comparative steels: Steel Nos. 51 to 80).

In addition, the materials of the steel ingredients shown in Steel Nos. 1 to 4 of Table 2 were used to prepare H-section steels of flange thicknesses of 21 mm under the rolling conditions shown in Table 6.

[Evaluation Test]

Samples of fire-resistant steels produced by the above method were tested for evaluation as follows:

First, the tensile characteristics and Charpy impact characteristics were measured and evaluated by taking test pieces from the ½ part of plate thickness and the rolling longitudinal (L) direction of the samples of the fire-resistant steels.

The yield strength (yield stress) was evaluated by a top yield point when a top yield point clearly appears on a stress-strain curve graph at the time of a test run based on the tensile test method described in JIS Z 2241 and the 0.2% yield strength when it does not. The results are shown in Table 3 and Table 5.

The base material toughness was evaluated by measurement of absorption energy measured by a Charpy impact test at 0° C. using a No. 4 impact test piece given a 2 mmV notch based on JIS Z 2242. At this time, the threshold value of the toughness was made 27 J considering the earthquake resistance of building structures.

For the high temperature strength (high temperature yield strength), high temperature tensile test pieces with diameters of parallel parts of ϕ6 mm and lengths of parallel parts of 30 mm were taken from samples of the fire-resistant steel. Based on the high temperature tensile test described in JIS G 0567, the test pieces were deformed at a tensile strain speed of 0.5%/min and stress-strain graphs were taken to measure the high temperature yield strength. The yield strengths at this time were all made 0.2% yield strengths.

For the toughness of the weld joint, that is, the embrittlement resistance characteristics, samples of the fire-resistant steel were used to form weld joints by forming 45 degree X-grooves and welding without preheating or post-heating by three layers or more of TIG welding (tungsten inert gas arc welding) or SAW (submerged arc welding). The weld joints were evaluated by the above-mentioned method for toughness of the weld joint, that is, the embrittlement resistance characteristic. At this time, fact that the weld heat input was a constant 5 k to 6 kJ/mm was confirmed by calculation from the output, current, and voltage value at the time of welding.

Further, for an indicator for judgment of embrittlement of a weld joint after fire, in the same way, a steel material was produced, then a weld joint was actually formed by a 5 kJ/mm heat input, the weld joint as a whole was raised to various temperatures of 600° C. in 1 hour, held there for 0.5 hour, then subjected to tensile tests at that temperature. The breakage reduction of area was made the SR reduction of area. In FIG. 1, when the SR reduction of area was less than 15%, the fracture face after the tensile test was observed under a scan electron microscope. By observation of the fracture face at that time, it was learned that the grain boundary breakage rate became 50% or more. It could be judged that reheat embrittlement remarkably occurred, so the threshold value of the SR reduction of area was made 15%.

A list of the compositions of chemical ingredients of the fire-resistant steels of the invention steels in the examples is shown in the following Table 2 and a list of the production conditions of the steel materials is shown in the following Table 3. Further, a list of the compositions of chemical ingredients of the comparative steels is shown in the following Table 4 and a list of the production conditions of the steel materials is shown in the following Table 5. Further, a list of the results of evaluation of the mechanical properties of the fire-resistant steels of the invention steels is shown in the following Table 3 and a list of the results of evaluation of the mechanical properties of the fire-resistant steels of the comparative steels is shown in the following Table 5. Further, the production conditions of the H-section steel comprised of the chemical ingredients of the present invention and results of evaluation of the mechanical properties are shown in Table 6.

Note that, in Tables 2 and 4, SRS is the calculated value of an indicator of reheat embrittlement of a weld joint represented by 4[% Cr]-5[% Mo]-10[% Ni]-2[% Cu]-[% Mn].

In Tables 3, 5, and 6, the items mean the following:

YS (RT): Tensile yield strength at room temperature

YS (600): High temperature tensile yield strength at temperature of 600° C.

YR: Value of ratio of yield strength at room temperature/tensile strength shown indexed to 100% vE0-B: Charpy absorption energy of steel material at 0° C.

vE0-W: Charpy absorption energy of weld reproduced HAZ corresponding to 5 to 6 kJ/mm heat input Cooling speed after rolling: Average cooling speed when passing through 800 to 500° C. or average cooling speed after end of rolling from 800 to water cooling stop temperature SR reduction of area: Value of reduction of area of breakage when imparting heat cycle corresponding to weld joint, then running high temperature tensile test at 600° C.

TABLE 2

| | Steel | Elements (mass %) | | | | | | | | | | | |
|---|---|---|---|---|---|---|---|---|---|---|---|---|---|
| | No. | C | Si | Mn | Cr | P | S | Nb | V | Mo | Ni | Cu | Al |
| INVENTION STEEL | 1 | 0.0175 | 0.30 | 1.57 | 0.97 | 0.003 | 0.0033 | 0.0944 | 0.080 | 0.04 | 0.01 | 0.03 | 0.037 |
| | 2 | 0.0288 | 0.43 | 1.02 | 1.37 | 0.016 | 0.0019 | 0.0697 | 0.213 | 0.02 | 0.02 | 0.04 | 0.053 |
| | 3 | 0.0400 | 0.41 | 1.33 | 0.61 | 0.002 | 0.0014 | 0.0225 | 0.201 | 0.02 | 0.01 | 0.01 | 0.030 |
| | 4 | 0.0181 | 0.21 | 1.73 | 1.77 | 0.016 | 0.0041 | 0.0127 | 0.051 | 0.09 | 0.04 | 0.01 | 0.009 |
| | 5 | 0.0389 | 0.33 | 1.74 | 0.83 | 0.005 | 0.0012 | 0.0211 | 0.147 | 0.01 | 0.02 | 0.08 | 0.043 |
| | 6 | 0.0416 | 0.26 | 1.53 | 1.48 | 0.017 | 0.0027 | 0.0334 | 0.221 | 0.07 | 0.03 | 0.01 | 0.021 |
| | 7 | 0.0260 | 0.10 | 1.59 | 1.85 | 0.014 | 0.0011 | 0.0171 | 0.166 | 0.08 | 0.06 | 0.07 | 0.045 |
| | 8 | 0.0379 | 0.29 | 1.18 | 1.96 | 0.011 | 0.0039 | 0.0701 | 0.211 | 0.02 | 0.02 | 0.05 | 0.023 |
| | 9 | 0.0466 | 0.43 | 1.66 | 1.79 | 0.016 | 0.0034 | 0.0894 | 0.188 | 0.05 | 0.07 | 0.03 | 0.007 |
| | 10 | 0.0165 | 0.46 | 1.31 | 1.85 | 0.015 | 0.0030 | 0.0390 | 0.261 | 0.05 | 0.02 | 0.06 | 0.086 |
| | 11 | 0.0468 | 0.05 | 1.04 | 0.86 | 0.013 | 0.0020 | 0.0809 | 0.281 | 0.08 | 0.01 | 0.06 | 0.051 |
| | 12 | 0.0299 | 0.07 | 0.97 | 1.07 | 0.007 | 0.0017 | 0.0289 | 0.045 | 0.08 | 0.04 | 0.06 | 0.037 |
| | 13 | 0.0211 | 0.15 | 0.84 | 1.74 | 0.016 | 0.0012 | 0.0876 | 0.196 | 0.06 | 0.07 | 0.04 | 0.045 |
| | 14 | 0.0247 | 0.23 | 1.70 | 1.18 | 0.003 | 0.0035 | 0.0907 | 0.098 | 0.06 | 0.00 | 0.02 | 0.031 |
| | 15 | 0.0350 | 0.16 | 1.18 | 1.97 | 0.013 | 0.0039 | 0.0866 | 0.210 | 0.08 | 0.07 | 0.01 | 0.008 |
| | 16 | 0.0173 | 0.20 | 1.84 | 1.12 | 0.017 | 0.0033 | 0.0882 | 0.064 | 0.07 | 0.05 | 0.02 | 0.021 |
| | 17 | 0.0322 | 0.39 | 1.41 | 1.74 | 0.013 | 0.0025 | 0.0349 | 0.154 | 0.06 | 0.00 | 0.08 | 0.056 |
| | 18 | 0.0251 | 0.16 | 0.88 | 1.81 | 0.009 | 0.0019 | 0.0109 | 0.072 | 0.04 | 0.05 | 0.03 | 0.048 |

TABLE 2-continued

| | | | | | | | | | | | | |
|---|---|---|---|---|---|---|---|---|---|---|---|---|
| 19 | 0.0269 | 0.36 | 1.61 | 0.87 | 0.008 | 0.0016 | 0.0681 | 0.264 | 0.08 | 0.02 | 0.03 | 0.053 |
| 20 | 0.0152 | 0.23 | 1.89 | 1.52 | 0.012 | 0.0014 | 0.0519 | 0.129 | 0.07 | 0.03 | 0.02 | 0.005 |
| 21 | 0.0462 | 0.42 | 1.42 | 1.08 | 0.014 | 0.0015 | 0.0839 | 0.272 | 0.05 | 0.01 | 0.04 | 0.025 |
| 22 | 0.0264 | 0.39 | 1.44 | 0.79 | 0.009 | 0.0027 | 0.0646 | 0.226 | 0.01 | 0.07 | 0.07 | 0.015 |
| 23 | 0.0232 | 0.26 | 1.77 | 1.15 | 0.007 | 0.0041 | 0.0134 | 0.069 | 0.07 | 0.02 | 0.06 | 0.042 |
| 24 | 0.0204 | 0.08 | 1.82 | 1.43 | 0.011 | 0.0041 | 0.0823 | 0.267 | 0.00 | 0.01 | 0.05 | 0.012 |
| 25 | 0.0362 | 0.16 | 1.66 | 0.72 | 0.009 | 0.0017 | 0.0240 | 0.132 | 0.05 | 0.03 | 0.08 | 0.048 |
| 26 | 0.0202 | 0.21 | 0.99 | 1.36 | 0.005 | 0.0034 | 0.0675 | 0.140 | 0.05 | 0.02 | 0.07 | 0.051 |
| 27 | 0.0192 | 0.10 | 1.44 | 1.23 | 0.007 | 0.0041 | 0.0246 | 0.209 | 0.01 | 0.03 | 0.04 | 0.008 |
| 28 | 0.0412 | 0.05 | 1.09 | 0.84 | 0.014 | 0.0005 | 0.0820 | 0.055 | 0.07 | 0.04 | 0.08 | 0.011 |
| 29 | 0.0122 | 0.10 | 1.43 | 0.94 | 0.004 | 0.0020 | 0.0562 | 0.089 | 0.06 | 0.05 | 0.02 | 0.020 |
| 30 | 0.0167 | 0.23 | 1.76 | 1.67 | 0.013 | 0.0022 | 0.0352 | 0.245 | 0.02 | 0.06 | 0.06 | 0.091 |
| 31 | 0.0178 | 0.44 | 1.02 | 0.77 | 0.008 | 0.0030 | 0.0542 | 0.120 | 0.00 | 0.07 | 0.08 | 0.060 |
| 32 | 0.0337 | 0.08 | 0.93 | 1.24 | 0.015 | 0.0028 | 0.0922 | 0.092 | 0.06 | 0.06 | 0.03 | 0.044 |
| 33 | 0.0379 | 0.20 | 1.52 | 1.93 | 0.011 | 0.0013 | 0.0526 | 0.136 | 0.08 | 0.05 | 0.08 | 0.006 |
| 34 | 0.0430 | 0.24 | 1.25 | 1.44 | 0.004 | 0.0042 | 0.0208 | 0.176 | 0.00 | 0.04 | 0.08 | 0.057 |
| 35 | 0.0343 | 0.49 | 1.82 | 0.95 | 0.008 | 0.0017 | 0.0844 | 0.228 | 0.07 | 0.05 | 0.03 | 0.042 |
| 36 | 0.0185 | 0.17 | 1.79 | 1.20 | 0.013 | 0.0020 | 0.0105 | 0.219 | 0.03 | 0.04 | 0.02 | 0.052 |
| 37 | 0.0107 | 0.20 | 0.87 | 0.75 | 0.006 | 0.0005 | 0.0207 | 0.081 | 0.05 | 0.01 | 0.03 | 0.024 |
| 38 | 0.0372 | 0.29 | 1.45 | 1.86 | 0.004 | 0.0008 | 0.0177 | 0.263 | 0.04 | 0.05 | 0.03 | 0.036 |
| 39 | 0.0191 | 0.35 | 1.22 | 1.50 | 0.014 | 0.0042 | 0.0355 | 0.047 | 0.09 | 0.03 | 0.01 | 0.029 |
| 40 | 0.0269 | 0.04 | 1.03 | 1.16 | 0.015 | 0.0022 | 0.0351 | 0.032 | 0.00 | 0.01 | 0.07 | 0.018 |
| 41 | 0.0441 | 0.14 | 1.20 | 1.00 | 0.003 | 0.0020 | 0.0174 | 0.283 | 0.04 | 0.01 | 0.05 | 0.022 |

| | Steel | Elements (mass %) | | | | | | | | | | |
|---|---|---|---|---|---|---|---|---|---|---|---|---|
| | No. | N | B | O | Ti | Zr | Ca | Mg | Y | Ce | La | SRS |
| INVENTION STEEL | 1 | 0.0061 | 0.0001 | 0.0014 | | | | | | | | 1.95 |
| | 2 | 0.0073 | 0.0000 | 0.0040 | | | | | | | | 4.11 |
| | 3 | 0.0048 | 0.0002 | 0.0037 | | | | | | | | 0.95 |
| | 4 | 0.0041 | 0.0001 | 0.0011 | | | | | | | | 4.51 |
| | 5 | 0.0023 | 0.0001 | 0.0019 | | | | | | | | 1.23 |
| | 6 | 0.0029 | 0.0001 | 0.0047 | | | | | | | | 3.75 |
| | 7 | 0.0024 | 0.0001 | 0.0021 | | | | | | | | 4.73 |
| | 8 | 0.0014 | 0.0001 | 0.0052 | | | | | | | | 6.29 |
| | 9 | 0.0012 | 0.0001 | 0.0022 | | | | | | | | 4.51 |
| | 10 | 0.0060 | 0.0002 | 0.0052 | | | | | | | | 5.51 |
| | 11 | 0.0061 | 0.0002 | 0.0053 | 0.013 | | | | | | | 1.74 |
| | 12 | 0.0041 | 0.0001 | 0.0029 | 0.015 | | | | | | | 2.39 |
| | 13 | 0.0055 | 0.0001 | 0.0023 | 0.016 | | | | | | | 5.11 |
| | 14 | 0.0042 | 0.0001 | 0.0053 | 0.018 | | | | | | | 2.66 |
| | 15 | 0.0011 | 0.0002 | 0.0007 | 0.026 | 0.0035 | | | | | | 5.59 |
| | 16 | 0.0031 | 0.0001 | 0.0019 | 0.037 | 0.0067 | | | | | | 1.77 |
| | 17 | 0.0044 | 0.0001 | 0.0027 | 0.044 | 0.0049 | | | | | | 5.05 |
| | 18 | 0.0049 | 0.0000 | 0.0029 | 0.023 | 0.0067 | | | | | | 5.59 |
| | 19 | 0.0022 | 0.0000 | 0.0019 | | 0.0078 | | | | | | 1.17 |
| | 20 | 0.0053 | 0.0001 | 0.0035 | | | | | | | | 3.48 |
| | 21 | 0.0034 | 0.0002 | 0.0041 | 0.019 | | | | | | | 2.40 |
| | 22 | 0.0062 | 0.0001 | 0.0029 | | | | | | | | 0.86 |
| | 23 | 0.0025 | 0.0000 | 0.0049 | | 0.0069 | 0.0035 | | | | | 2.18 |
| | 24 | 0.0019 | 0.0000 | 0.0008 | | 0.0080 | | 0.0018 | | | | 3.64 |
| | 25 | 0.0048 | 0.0002 | 0.0013 | 0.006 | | | | 0.012 | | | 0.44 |
| | 26 | 0.0072 | 0.0001 | 0.0021 | 0.007 | | | | | 0.011 | | 3.85 |
| | 27 | 0.0069 | 0.0001 | 0.0045 | 0.006 | | | | | | 0.007 | 3.05 |
| | 28 | 0.0035 | 0.0002 | 0.0033 | | | | 0.0047 | | | | 1.37 |
| | 29 | 0.0014 | 0.0001 | 0.0041 | | 0.0035 | 0.0028 | | 0.003 | 0.008 | | 1.54 |
| | 30 | 0.0054 | 0.0001 | 0.0036 | 0.008 | 0.0027 | 0.0026 | | | | 0.006 | 4.14 |
| | 31 | 0.0015 | 0.0000 | 0.0026 | | 0.0045 | | 0.0023 | | | | 1.24 |
| | 32 | 0.0051 | 0.0001 | 0.0029 | | 0.0029 | | | | | | 3.02 |
| | 33 | 0.0059 | 0.0002 | 0.0051 | | 0.0066 | 0.0026 | | | | | 5.17 |
| | 34 | 0.0049 | 0.0000 | 0.0047 | | | 0.0018 | | | 0.046 | | 3.88 |
| | 35 | 0.0069 | 0.0001 | 0.0034 | 0.015 | | 0.0019 | | | | 0.044 | 1.01 |
| | 36 | 0.0026 | 0.0001 | 0.0037 | | 0.0034 | 0.0026 | 0.0041 | | | | 2.44 |
| | 37 | 0.0063 | 0.0001 | 0.0054 | | 0.0033 | | | 0.004 | | | 1.70 |
| | 38 | 0.0039 | 0.0001 | 0.0034 | 0.016 | 0.0091 | 0.0006 | | | | | 5.18 |
| | 39 | 0.0021 | 0.0002 | 0.0041 | 0.017 | | | 0.0007 | | 0.046 | | 4.00 |
| | 40 | 0.0054 | 0.0002 | 0.0031 | | | 0.0043 | | 0.045 | | 0.002 | 3.37 |
| | 41 | 0.0069 | 0.0001 | 0.0038 | | 0.0009 | | 0.0046 | | 0.003 | | 2.44 |

TABLE 3

| | Steel No. | Heating temp. before rolling (° C.) | Final rolling end temp. (° C.) | Cooling speed after rolling (° C./sec) | Cooling stop temp. (° C.) | Tempering temp. (° C.) | Tempering time (hr) | YS (RT) (N/mm$^2$) | YR (%) | YS (600) (N/mm$^2$) | SR reduction of area (%) | vEO-B (J) | vEO-W (J) |
|---|---|---|---|---|---|---|---|---|---|---|---|---|---|
| | | Mechanical properties to be evaluated and control items | | | | | | | | | | | |
| INVENTION STEEL | 1 | 1160 | 860 | 3 | 520 | | | 355 | 77 | 199 | 27 | 166 | 207 |
| | 2 | 1160 | 860 | 5 | 520 | | | 364 | 72 | 214 | 36 | 159 | 243 |
| | 3 | 1160 | 840 | 3 | 520 | | | 352 | 68 | 215 | 25 | 175 | 222 |
| | 4 | 1160 | 840 | 6 | 550 | | | 329 | 66 | 173 | 60 | 279 | 136 |
| | 5 | 1160 | 840 | 8 | 550 | 420 | 2.5 | 357 | 78 | 217 | 21 | 164 | 170 |
| | 6 | 1160 | 820 | 8 | 550 | 450 | 5.5 | 381 | 79 | 244 | 40 | 190 | 219 |
| | 7 | 1160 | 820 | 2 | 400 | | | 361 | 65 | 209 | 56 | 210 | 116 |
| | 8 | 1160 | 920 | 5 | 400 | | | 379 | 68 | 233 | 58 | 427 | 273 |
| | 9 | 1160 | 920 | 6 | 400 | | | 405 | 70 | 269 | 38 | 393 | 105 |
| | 10 | 1180 | 960 | 7 | 60 | 550 | 4.0 | 384 | 82 | 224 | 54 | 379 | 120 |
| | 11 | 1180 | 960 | 9 | 60 | 550 | 3.0 | 388 | 83 | 259 | 58 | 202 | 237 |
| | 12 | 1180 | 980 | 12 | 80 | 600 | 1.0 | 292 | 85 | 149 | 66 | 226 | 129 |
| | 13 | 1180 | 980 | 15 | 80 | | | 360 | 65 | 205 | 44 | 248 | 201 |
| | 14 | 1180 | 980 | 15 | 450 | | | 370 | 64 | 222 | 24 | 428 | 153 |
| | 15 | 1180 | 980 | 15 | 450 | | | 387 | 65 | 245 | 48 | 333 | 201 |
| | 16 | 1180 | 920 | 15 | 450 | | | 366 | 66 | 216 | 27 | 158 | 251 |
| | 17 | 1180 | 920 | 15 | 450 | | | 361 | 63 | 220 | 56 | 196 | 103 |
| | 18 | 1180 | 920 | 15 | 480 | | | 296 | 62 | 145 | 70 | 241 | 279 |
| | 19 | 1200 | 900 | 16 | 480 | | | 403 | 59 | 259 | 25 | 197 | 190 |
| | 20 | 1200 | 900 | 16 | 480 | | | 374 | 58 | 215 | 38 | 375 | 246 |
| | 21 | 1200 | 900 | 16 | 360 | | | 410 | 58 | 280 | 44 | 196 | 248 |
| | 22 | 1200 | 900 | 12 | 360 | | | 381 | 58 | 231 | 24 | 261 | 223 |
| | 23 | 1200 | 900 | 12 | 550 | | | 332 | 65 | 183 | 36 | 408 | 243 |
| | 24 | 1200 | 1000 | 10 | 25 | | | 422 | 55 | 264 | 27 | 215 | 262 |
| | 25 | 1220 | 1020 | 10 | 25 | | | 348 | 52 | 209 | 28 | 319 | 242 |
| | 26 | 1220 | 1010 | 5 | 25 | | | 338 | 65 | 183 | 38 | 364 | 201 |
| | 27 | 1220 | 980 | 5 | 25 | | | 362 | 63 | 203 | 35 | 260 | 105 |
| | 28 | 1220 | 980 | 5 | 25 | 480 | 1.0 | 321 | 78 | 185 | 45 | 438 | 152 |
| | 29 | 1220 | 980 | 5 | 25 | 550 | 1.0 | 333 | 79 | 173 | 60 | 236 | 153 |
| | 30 | 1220 | 980 | 40 | 25 | 650 | 1.0 | 398 | 83 | 237 | 72 | 308 | 184 |
| | 31 | 1230 | 950 | 40 | 25 | 700 | 0.5 | 322 | 85 | 165 | 46 | 370 | 246 |
| | 32 | 1250 | 950 | 4 | 480 | | | 331 | 75 | 188 | 37 | 228 | 256 |
| | 33 | 1230 | 950 | 3 | 480 | | | 366 | 72 | 225 | 54 | 173 | 186 |
| | 34 | 1250 | 950 | 3 | 460 | | | 348 | 75 | 206 | 46 | 423 | 273 |
| | 35 | 1280 | 950 | 3 | 460 | | | 414 | 78 | 276 | 32 | 299 | 280 |
| | 36 | 1200 | 950 | 4 | 420 | | | 376 | 76 | 218 | 31 | 275 | 141 |
| | 37 | 1250 | 950 | 6 | 50 | | | 287 | 69 | 127 | 56 | 312 | 156 |
| | 38 | 1250 | 950 | 6 | 40 | 700 | 0.1 | 388 | 78 | 246 | 54 | 321 | 143 |
| | 39 | 1250 | 950 | 11 | 60 | 700 | 0.2 | 311 | 79 | 160 | 46 | 299 | 126 |
| | 40 | 1200 | 950 | 11 | 470 | 650 | 0.2 | 293 | 78 | 139 | 32 | 345 | 135 |
| | 41 | 1200 | 950 | 13 | 25 | | | 371 | 72 | 235 | 61 | 322 | 144 |

TABLE 4

| | Steel No. | C | Si | Mn | Cr | P | S | Nb | V | Mo | Ni | Cu | Al | N |
|---|---|---|---|---|---|---|---|---|---|---|---|---|---|---|
| | | Elements (mass %) | | | | | | | | | | | | |
| COMPARATIVE STEEL | 51 | 0.0630 | 0.47 | 1.45 | 0.61 | 0.009 | 0.0025 | 0.072 | 0.428 | 0.08 | 0.00 | 0.07 | 0.0730 | 0.0064 |
| | 52 | 0.0070 | 0.33 | 1.63 | 1.47 | 0.009 | 0.0031 | 0.073 | 0.344 | 0.06 | 0.03 | 0.02 | 0.0336 | 0.0057 |
| | 53 | 0.0307 | 0.67 | 0.99 | 1.62 | 0.008 | 0.0018 | 0.093 | 0.143 | 0.02 | 0.07 | 0.03 | 0.0483 | 0.0070 |
| | 54 | 0.0247 | 0.12 | 2.81 | 0.76 | 0.009 | 0.0019 | 0.055 | 0.426 | 0.09 | 0.05 | 0.01 | 0.0603 | 0.0050 |
| | 54-2 | 0.0251 | 0.10 | 0.71 | 0.65 | 0.010 | 0.0021 | 0.061 | 0.239 | 0.09 | 0.05 | 0.02 | 0.0662 | 0.0049 |
| | 54-3 | 0.0325 | 0.08 | 2.15 | 0.75 | 0.009 | 0.0017 | 0.059 | 0.223 | 0.08 | 0.04 | 0.02 | 0.0612 | 0.0052 |
| | 55 | 0.0371 | 0.09 | 1.75 | 4.56 | 0.004 | 0.0006 | 0.078 | 0.387 | 0.01 | 0.02 | 0.01 | 0.0739 | 0.0035 |
| | 56 | 0.0206 | 0.19 | 1.69 | 0.33 | 0.014 | 0.0029 | 0.068 | 0.271 | 0.07 | 0.06 | 0.05 | 0.0253 | 0.0072 |
| | 56-2 | 0.0198 | 0.23 | 1.24 | 0.43 | 0.013 | 0.0036 | 0.071 | 0.250 | 0.04 | 0.02 | 0.01 | 0.0312 | 0.0055 |
| | 56-3 | 0.0211 | 0.30 | 1.35 | 2.14 | 0.010 | 0.0030 | 0.080 | 0.282 | 0.06 | 0.04 | 0.03 | 0.0333 | 0.0061 |
| | 57 | 0.0439 | 0.33 | 0.83 | 0.65 | 0.016 | 0.0039 | 0.130 | 0.238 | 0.05 | 0.05 | 0.05 | 0.0516 | 0.0056 |
| | 57-2 | 0.0444 | 0.29 | 0.95 | 0.96 | 0.011 | 0.0031 | 0.004 | 0.225 | 0.05 | 0.06 | 0.05 | 0.0449 | 0.0059 |
| | 58 | 0.0428 | 0.09 | 1.89 | 0.70 | 0.013 | 0.0022 | 0.019 | 0.610 | 0.03 | 0.02 | 0.04 | 0.0316 | 0.0046 |
| | 58-2 | 0.0410 | 0.08 | 1.75 | 0.76 | 0.009 | 0.0025 | 0.020 | 0.326 | 0.04 | 0.03 | 0.05 | 0.0297 | 0.0055 |
| | 58-3 | 0.0399 | 0.08 | 1.83 | 0.74 | 0.011 | 0.0033 | 0.020 | 0.024 | 0.03 | 0.04 | 0.05 | 0.0324 | 0.0048 |
| | 59 | 0.0278 | 0.08 | 0.86 | 1.62 | 0.010 | 0.0005 | 0.041 | 0.259 | 0.13 | 0.03 | 0.02 | 0.0185 | 0.0074 |
| | 60 | 0.0188 | 0.02 | 1.81 | 0.90 | 0.011 | 0.0030 | 0.081 | 0.135 | 0.01 | 0.17 | 0.02 | 0.0601 | 0.0011 |
| | 61 | 0.0196 | 0.28 | 1.68 | 0.66 | 0.014 | 0.0010 | 0.034 | 0.225 | 0.01 | 0.03 | 0.26 | 0.0416 | 0.0027 |
| | 61-2 | 0.0178 | 0.25 | 0.87 | 1.34 | 0.012 | 0.0011 | 0.036 | 0.234 | 0.01 | 0.01 | 0.13 | 0.0444 | 0.0031 |
| | 61-3 | 0.0168 | 0.48 | 0.91 | 1.22 | 0.021 | 0.0010 | 0.040 | 0.255 | 0.01 | 0.01 | 0.03 | 0.0041 | 0.0051 |
| | 61-4 | 0.0159 | 0.28 | 0.98 | 1.19 | 0.024 | 0.0010 | 0.042 | 0.261 | 0.01 | 0.01 | 0.03 | 0.1098 | 0.0042 |

TABLE 4-continued

| | | | | | | | | | | | | | |
|---|---|---|---|---|---|---|---|---|---|---|---|---|---|
| 61-5 | 0.0166 | 0.30 | 1.02 | 1.30 | 0.023 | 0.0012 | 0.044 | 0.245 | 0.01 | 0.01 | 0.02 | 0.0425 | 0.0039 |
| 62 | 0.0144 | 0.37 | 1.40 | 0.82 | 0.017 | 0.0042 | 0.012 | 0.094 | 0.08 | 0.04 | 0.01 | 0.0375 | 0.0160 |
| 63 | 0.0171 | 0.49 | 1.19 | 1.13 | 0.006 | 0.0042 | 0.038 | 0.129 | 0.01 | 0.06 | 0.02 | 0.0319 | 0.0066 |
| 64 | 0.0144 | 0.36 | 1.18 | 1.91 | 0.009 | 0.0017 | 0.014 | 0.198 | 0.05 | 0.02 | 0.03 | 0.0718 | 0.0057 |
| 65 | 0.0437 | 0.06 | 1.56 | 1.81 | 0.028 | 0.0024 | 0.035 | 0.341 | 0.08 | 0.07 | 0.05 | 0.0225 | 0.0072 |
| 66 | 0.0274 | 0.19 | 0.89 | 1.12 | 0.014 | 0.0077 | 0.075 | 0.121 | 0.02 | 0.01 | 0.04 | 0.0329 | 0.0074 |
| 67 | 0.0409 | 0.15 | 1.12 | 0.87 | 0.010 | 0.0019 | 0.031 | 0.449 | 0.05 | 0.04 | 0.06 | 0.0243 | 0.0058 |
| 68 | 0.0171 | 0.37 | 1.63 | 0.65 | 0.006 | 0.0030 | 0.018 | 0.066 | 0.05 | 0.03 | 0.07 | 0.0639 | 0.0013 |
| 69 | 0.0387 | 0.43 | 1.18 | 1.56 | 0.010 | 0.0015 | 0.027 | 0.418 | 0.01 | 0.03 | 0.05 | 0.0251 | 0.0036 |
| 70 | 0.0337 | 0.18 | 1.35 | 0.62 | 0.015 | 0.0030 | 0.055 | 0.435 | 0.08 | 0.04 | 0.08 | 0.0695 | 0.0061 |
| 71 | 0.0395 | 0.17 | 1.79 | 1.06 | 0.006 | 0.0017 | 0.082 | 0.197 | 0.09 | 0.06 | 0.01 | 0.0182 | 0.0028 |
| 72 | 0.0214 | 0.49 | 1.43 | 1.45 | 0.006 | 0.0037 | 0.075 | 0.424 | 0.08 | 0.06 | 0.01 | 0.0633 | 0.0044 |
| 73 | 0.0164 | 0.36 | 0.89 | 0.70 | 0.013 | 0.0023 | 0.044 | 0.182 | 0.01 | 0.01 | 0.06 | 0.0429 | 0.0057 |
| 74 | 0.0388 | 0.30 | 1.98 | 0.66 | 0.003 | 0.0032 | 0.014 | 0.117 | 0.08 | 0.09 | 0.08 | 0.0406 | 0.0011 |
| 75 | 0.0135 | 0.09 | 1.01 | 1.83 | 0.007 | 0.0027 | 0.030 | 0.378 | 0.07 | 0.06 | 0.01 | 0.0401 | 0.0058 |
| 76 | 0.0386 | 0.40 | 1.58 | 0.82 | 0.002 | 0.0029 | 0.069 | 0.143 | 0.03 | 0.05 | 0.08 | 0.0387 | 0.0028 |
| 77 | 0.0297 | 0.30 | 1.57 | 1.54 | 0.010 | 0.0036 | 0.014 | 0.219 | 0.02 | 0.02 | 0.01 | 0.0381 | 0.0070 |
| 78 | 0.0290 | 0.29 | 0.98 | 1.53 | 0.015 | 0.0035 | 0.030 | 0.232 | 0.01 | 0.06 | 0.04 | 0.0462 | 0.0063 |
| 79 | 0.0281 | 0.26 | 1.57 | 0.86 | 0.013 | 0.0016 | 0.041 | 0.152 | 0.03 | 0.01 | 0.08 | 0.0597 | 0.0045 |
| 80 | 0.0317 | 0.24 | 1.46 | 1.12 | 0.007 | 0.0060 | 0.025 | 0.120 | 0.01 | 0.02 | 0.01 | 0.0359 | 0.0036 |

| | Steel | Elements (mass %) | | | | | | | | | |
|---|---|---|---|---|---|---|---|---|---|---|---|
| | No. | B | O | Ti | Zr | Ca | Mg | Y | Ce | La | SRS |
| COMPARATIVE STEEL | 51 | 0.0000 | 0.0016 | | | | | | | | 0.4 |
| | 52 | 0.0002 | 0.0023 | | | | | | | | 3.6 |
| | 53 | 0.0000 | 0.0012 | | | | | | | | 4.6 |
| | 54 | 0.0001 | 0.0047 | | | | | | | | −0.7 |
| | 54-2 | 0.0001 | 0.0040 | | | | | | | | 0.9 |
| | 54-3 | 0.0001 | 0.0037 | | | | | | | | 0.0 |
| | 55 | 0.0000 | 0.0019 | | | | | | | | 16.1 |
| | 56 | 0.0001 | 0.0011 | | | | | | | | −1.4 |
| | 56-2 | 0.0001 | 0.0020 | | | | | | | | 0.0 |
| | 56-3 | 0.0001 | 0.0020 | | | | | | | | 6.4 |
| | 57 | 0.0001 | 0.0043 | | | | | | | | 0.8 |
| | 57-2 | 0.0001 | 0.0039 | | | | | | | | 1.9 |
| | 58 | 0.0001 | 0.0039 | | | | | | | | 0.4 |
| | 58-2 | 0.0001 | 0.0041 | | | | | | | | 0.6 |
| | 58-3 | 0.0001 | 0.0040 | | | | | | | | 0.4 |
| | 59 | 0.0001 | 0.0013 | | | | | | | | 4.5 |
| | 60 | 0.0000 | 0.0024 | | | | | | | | −0.0 |
| | 61 | 0.0000 | 0.0045 | | | | | | | | 0.1 |
| | 61-2 | 0.0000 | 0.0049 | | | | | | | | 4.0 |
| | 61-3 | 0.0000 | 0.0097 | | | | | | | | 3.7 |
| | 61-4 | 0.0000 | 0.0017 | | | | | | | | 3.5 |
| | 61-5 | 0.0004 | 0.0025 | | | | | | | | 3.9 |
| | 62 | 0.0002 | 0.0035 | 0.012 | | | | | | | 1.1 |
| | 63 | 0.0018 | 0.0008 | 0.011 | 0.0080 | | | | | | 2.6 |
| | 64 | 0.0002 | 0.0190 | | 0.0070 | | | | | | 6.0 |
| | 65 | 0.0000 | 0.0017 | | | | | | | | 4.5 |
| | 66 | 0.0000 | 0.0015 | 0.007 | | | | | | | 3.3 |
| | 67 | 0.0000 | 0.0052 | 0.081 | | | | | | | 1.6 |
| | 68 | 0.0002 | 0.0020 | | 0.0260 | | | | | | 0.2 |
| | 69 | 0.0001 | 0.0030 | | | 0.0062 | | | | | 4.6 |
| | 70 | 0.0001 | 0.0021 | | | | 0.0071 | | | | 0.1 |
| | 71 | 0.0001 | 0.0021 | | | | | 0.0990 | | | 1.3 |
| | 72 | 0.0001 | 0.0035 | | | | | | 0.0760 | | 3.3 |
| | 73 | 0.0001 | 0.0049 | | | | | | | 0.0825 | 1.6 |
| | 74 | 0.0001 | 0.0008 | | | | | | | | −0.8 |
| | 75 | 0.0001 | 0.0041 | | | | | | | | 5.2 |
| | 76 | 0.0001 | 0.0033 | | | | | | | | 0.9 |
| | 77 | 0.0001 | 0.0013 | | | | | | | | 4.2 |
| | 78 | 0.0001 | 0.0036 | | | | | | | | 4.4 |
| | 79 | 0.0002 | 0.0015 | | | | | | | | 1.4 |
| | 80 | 0.0000 | 0.0033 | | | | | | | | 2.7 |

TABLE 5

| | Steel No. | Heating temp. before rolling (° C.) | Final rolling end temp. (° C.) | Cooling speed after rolling (° C. sec) | Cooling stop temp. (° C.) | Tempering temp. (° C.) | Tempering time (hr) | YS (RT) (N/mm$^2$) | YR (%) | YS (600) (N/mm$^2$) | SR reduction of area (%) | vEO-B (J) | vEO-W (J) |
|---|---|---|---|---|---|---|---|---|---|---|---|---|---|
| | | Mechanical properties to be evaluated and control items | | | | | | | | | | | |
| COMPARATIVE STEEL | 51 | 1200 | 960 | 22 | 450 | | | 613 | 86 | 313 | 3 | 168 | 153 |
| | 52 | 1200 | 960 | 22 | 450 | | | 212 | 78 | 81 | 65 | 332 | 15 |
| | 53 | 1200 | 960 | 22 | 400 | | | 299 | 65 | 145 | 36 | 11 | 160 |
| | 54 | 1200 | 960 | 22 | 400 | | | 615 | 96 | 288 | 4 | 312 | 153 |
| | 54-2 | 1200 | 960 | 22 | 400 | | | 230 | 84 | 115 | 38 | 123 | 145 |
| | 54-3 | 1200 | 960 | 22 | 400 | | | 584 | 92 | 290 | 13 | 21 | 13 |
| | 55 | 1200 | 960 | 15 | 400 | 400 | 2.5 | 512 | 58 | 344 | 86 | 167 | 15 |
| | 56 | 1200 | 960 | 15 | 400 | 400 | 5.5 | 200 | 67 | 76 | 12 | 188 | 12 |
| | 56-2 | 1200 | 960 | 15 | 400 | | | 209 | 70 | 90 | 14 | 180 | 45 |
| | 56-3 | 1200 | 960 | 15 | 400 | | | 473 | 61 | 333 | 70 | 171 | 24 |
| | 57 | 1200 | 960 | 15 | 400 | | | 455 | 84 | 299 | 6 | 13 | 5 |
| | 57-2 | 1200 | 960 | 15 | 400 | | | 209 | 69 | 107 | 42 | 161 | 155 |
| | 58 | 1200 | 960 | 15 | 400 | | | 489 | 78 | 269 | 2 | 24 | 5 |
| | 58-2 | 1200 | 960 | 15 | 400 | | | 477 | 76 | 257 | 10 | 31 | 10 |
| | 58-3 | 1200 | 960 | 15 | 400 | | | 285 | 72 | 106 | 43 | 254 | 166 |
| | 59 | 1200 | 960 | 15 | 400 | | | 341 | 78 | 235 | 5 | 215 | 45 |
| | 60 | 1200 | 960 | 15 | 400 | 550 | 4.0 | 414 | 83 | 251 | 7 | 198 | 61 |
| | 61 | 1200 | 960 | 15 | 400 | 550 | 3.0 | 298 | 84 | 207 | 6 | 57 | 128 |
| | 61-2 | 1200 | 960 | 15 | 400 | | | 300 | 82 | 220 | 10 | 80 | 141 |
| | 61-3 | 1200 | 960 | 15 | 400 | | | 541 | 86 | 276 | 22 | 31 | 8 |
| | 61-4 | 1200 | 960 | 15 | 400 | | | 495 | 79 | 271 | 24 | 9 | 7 |
| | 61-5 | 1200 | 960 | 15 | 400 | | | 312 | 74 | 227 | 11 | 145 | 129 |
| | 62 | 1200 | 960 | 15 | 400 | 550 | 1.0 | 313 | 88 | 166 | 3 | 23 | 15 |
| | 63 | 1200 | 960 | 15 | 400 | | | 498 | 81 | 332 | 4 | 202 | 312 |
| | 64 | 1200 | 960 | 15 | 400 | | | 333 | 281 | 277 | 28 | 11 | 5 |
| | 65 | 1250 | 960 | 10 | 400 | 550 | 1.0 | 318 | 75 | 255 | 11 | 114 | 9 |
| | 66 | 1180 | 960 | 10 | 400 | 550 | 1.0 | 346 | 77 | 235 | 13 | 121 | 7 |
| | 67 | 1200 | 960 | 10 | 400 | | | 425 | 84 | 288 | 2 | 4 | 11 |
| | 68 | 1180 | 960 | 16 | 400 | | | 411 | 88 | 264 | 2 | 7 | 13 |
| | 69 | 1180 | 960 | 10 | 480 | | | 423 | 68 | 236 | 44 | 9 | 11 |
| | 70 | 1180 | 960 | 15 | 460 | | | 396 | 78 | 218 | 35 | 12 | 121 |
| | 71 | 1180 | 960 | 13 | 480 | | | 389 | 79 | 244 | 28 | 9 | 11 |
| | 72 | 1180 | 960 | 21 | 480 | | | 344 | 78 | 256 | 36 | 21 | 4 |
| | 73 | 1180 | 960 | 11 | 540 | | | 365 | 82 | 226 | 39 | 11 | 5 |
| | 74 | 1160 | 960 | 6 | 490 | | | 366 | 76 | 235 | 11 | 235 | 166 |
| | 75 | 1360 | 960 | 6 | 450 | | | 426 | 82 | 268 | 26 | 8 | 182 |
| | 76 | 1220 | 770 | 6 | 440 | 480 | 1.0 | 217 | 71 | 99 | 41 | 268 | 106 |
| | 77 | 1200 | 960 | 1 | 480 | 550 | 1.0 | 205 | 72 | 81 | 36 | 289 | 127 |
| | 78 | 1200 | 960 | 5 | 660 | 650 | 1.0 | 199 | 70 | 65 | 48 | 288 | 169 |
| | 79 | 1200 | 960 | 10 | 400 | 780 | 1.0 | 611 | 68 | 265 | 33 | 89 | 46 |
| | 80 | 1200 | 960 | 10 | 400 | 720 | 42.0 | 195 | 70 | 79 | 37 | 91 | 44 |

TABLE 6

| H-section steel | Steel no. | Heating temp. before rolling (° C.) | Final rolling end temp. (° C.)* flange part | Cooling after rolling | YS (RT) (N/mm$^2$) | YR (%) | YS (600) (N/mm$^2$) | SR reduction of area (%) | vEO-B (J) | vEO-W (J) |
|---|---|---|---|---|---|---|---|---|---|---|
| | | Mechanical properties to be evaluated and control items | | | | | | | | |
| Invention steel | 1 | 1250 | 800 | Passive cooling (cooling speed about 0.8 to 1.5° C./sec) | 335 | 79 | 168 | 33 | 123 | 156 |
| | 2 | 1250 | 820 | Passive cooling (cooling speed about 0.8 to 1.5° C./sec) | 349 | 75 | 176 | 35 | 104 | 196 |
| | 3 | 1250 | 810 | Passive cooling (cooling speed about 0.8 to 1.5° C./sec) | 342 | 76 | 181 | 32 | 133 | 178 |
| | 4 | 1250 | 800 | Passive cooling (cooling speed about 0.8 to 1.5° C./sec) | 325 | 74 | 159 | 53 | 204 | 98 |

*The steel numbers of this table correspond to the steel numbers of Table 2. The same slabs were used as materials.

[Result of Evaluation]

Steel Nos. 1 to 41 shown in Table 2 and Table 3 are invention steels, that is, examples of fire-resistant steels with a 600° C. assumed fire temperature. As shown by the results of measurement of the mechanical properties shown in Table 3, it was clear that in all steels, the values were 117N/mm$^2$ when the room temperature yield strength was 235N/mm$^2$ or more and further were 162N/mm$^2$ or more when the room temperature yield strength was 325N/mm$^2$ or more. The necessary high temperature characteristics were satisfied and both the base material and weld joint had values of 27 J or more at 0° C., so it became clear that the invention steels of the fire-resistant steels of Steel Nos. 1 to 41 had toughnesses of the steel materials and joint toughnesses satisfying the necessary performances.

Further, Table 2 shows SRS values as indicators of the limitation of chemical ingredients for preventing reheat embrittlement (unit: mass %). As shown in Table 2, the SRS values are all positive values in the invention steels.

Note that, regarding the controlled cooling conditions at the time of production shown in Table 3, the average cooling speed from 800 to 500° C. was described as is when cooling down to below 500° C. while the average cooling speed down to the stopping temperature was described when stopping in the middle at above 500° C. Further, in tempered steels, that temperature and holding time were also described.

Compared with the fire-resistant steels of the present invention steels as explained above, the fire-resistant steels of the comparative steels of Steel Nos. 51 to 80 shown in Table 4 and Table 5 did not satisfy the composition of chemical ingredients or production conditions prescribed in the present invention in some way, so as explained below, some sort of characteristic could not be satisfied as a result.

The fire-resistant steel of Steel No. 51 is an example where the amount of C became excessive with respect to the prescribed range of the present invention, so the high temperature yield strength exceeded the upper limit value of 590N/mm$^2$ of the standard for 600N/mm$^2$ class steel and further the quenchability was high, so clear old γ-grain boundaries appeared in the steel and the SR reduction of area at the time of evaluation of the reheat embrittlement resistance became low.

The fire-resistant steel of Steel No. 52 is an example where C was not sufficiently added, so in the alloy ingredient range of the present invention, the room temperature yield strength could not be secured and sufficient dislocation could not be introduced into the structure, so the amount of the carbides themselves was also small and the amount of carbides precipitating in the grains on the dislocations also fell and therefore the 600° C. high temperature yield strength fell. Furthermore, Steel No. 52 is an example where the quenchability fell and simultaneously the structure of the HAZ became mainly coarse ferrite and the HAZ toughness at the time of large heat-input welding of a 5 kJ/mm heat input fell below 27 J.

The fire-resistant steel of Steel No. 53 is an example where the amount of addition of Si was small, the deoxidation became insufficient, clusters of Mn-based oxides were formed, and the toughness of the steel material fell.

The fire-resistant steel of Steel No. 54 is an example where the Mn was added in excess and as a result the quenchability became too high, the room temperature yield strength exceeded the prescribed upper limit value of 590N/mm$^2$, the old γ-grain boundaries at the HAZ clearly appeared, further, the amount of Mn at the material was high, so the SRS became negative, and the SR reduction of area at the time of evaluation of the reheat embrittlement resistance fell below 15%. Further, the fire-resistant steel of Steel No. 54-2 is an example where the amount of Mn was less than 0.80%, that is, 0.71%, so the quenchability was insufficient and the yield strengths (yield stresses) at room temperature and 600° C. became insufficient. On the other hand, the fire-resistant steel of Steel No. 54-3 is an example where the amount of Mn became over 2.00%, that is, 2.15%, so the grain boundary strength dropped etc and thereby the SR reduction of area at the time of evaluation of the weld joint reheat embrittlement resistance became less than 15%, that is, a low 13%.

The fire-resistant steel of Steel No. 55 is an example where the amount of addition of Cr became excessive, the structure came to include a martensite structure, the precipitation of carbides increased at the clear γ-grain boundaries at the time of large heat-input welding, and the 0° C. Charpy impact absorption energy at the HAZ part of the weld joint was a low 15 J or below the target of 27 J.

The fire-resistant steel of Steel No. 56 is an example where the amount of addition of Cr was insufficient so the quenchability fell, the yield strengths at room temperature and 600° C. both fell, and further the SRS value became negative, the SR reduction of area at the time of evaluation of the reheat embrittlement resistance fell below 15%, the structure of the weld joint became mainly ferrite, and the toughness at the time of large heat-input welding was insufficient. Further, the fire-resistant steel of Steel No. 56-2 is an example where the amount of addition of Cr was insufficient so the quenchability fell, the yield strengths at room temperature and 600° C. both fell, and the SR reduction of area also fell below 15%. Further, the fire-resistant steel of Steel No. 56-3 had an amount of addition of Cr of a high 2.14% and the 0° C. Charpy impact absorption energy of the HAZ part of the weld joint failed to reach the target of 27 J.

The fire-resistant steel of Steel No. 57 is an example where the amount of Nb became excessive, NbC precipitated at the grain boundaries of the weld joint in a high density, the SR reduction of area at the time of evaluation of the reheat embrittlement resistance fell below 15%, coarse precipitation of NbC also occurred in the grains, and the toughness of the base material and the HAZ toughness at the time of large heat-input welding fell. On the other hand, the fire-resistant steel of Steel No. 57-2 is an example where the amount of Nb was less than 0.01%, that is, a low 0.004%, so the effect of improvement of the strength by the addition of Nb could not be sufficiently obtained and the yield strengths at room temperature and 600° C. failed to reach the target.

The fire-resistant steels of Steel Nos. 58 and 58-2 are examples where the amount of V became excessive and coarse VC carbides were formed, the SR reduction of area at the time of evaluation of the reheat embrittlement resistance fell below 15%, the structure of the weld joint became mainly ferrite so the toughness at the time of large heat-input welding became insufficient, and the base material also fell in toughness. Further, the fire-resistant steel of Steel No. 58-3 is an example where the amount of V was less than 0.03%, so the effect of improvement of the high temperature yield strength was not obtained and the 600° C. high temperature yield strength target could not be reached.

The fire-resistant steel of Steel No. 59 is an example where the amount of Mo was excessively added, so the 600° C. high temperature yield strength was secured, but the SR reduction of area at the time of evaluation of the weld joint reheat embrittlement resistance fell below 15%.

The fire-resistant steel of Steel No. 60 is an example where Ni entered and the amount became excessive, so only the grain boundaries dropped in transformation point, the SRS became negative, and the SR reduction of area at the time of evaluation of the weld joint reheat embrittlement resistance fell below 15%.

The fire-resistant steels of Steel Nos. 61 and 61-2 are examples where when Cu was added, in the same way as Ni, only the grain boundaries dropped in transformation point and the SR reduction of area at the time of evaluation of the weld joint reheat embrittlement resistance fell below 15%.

The fire-resistant steel of Steel No. 61-3 is an example where to lower the concentration of oxygen in the molten steel, instead of the Al to be added as a deoxidizing element, the deoxidizing element Si was just used for deoxidation, but the amount of formation of AlN became insufficient, so the toughness of the steel material was also low and the 0° C.

Charpy impact absorption energy of the HAZ part failed to reach the target of 27 J. On the other hand, Steel No. 61-4 had an excessive amount of Al, so coarse oxide clusters of several μm or more in size were formed, the toughness of the steel material fell, and the 0° C. Charpy impact absorption energy of the steel plate itself and the HAZ part failed to reach the target of 27 J.

The fire-resistant steel of Steel No. 61-5 is an example where due to the intermixture of B from scrap, alloy materials, etc., the B content become an excessive 0.0004% and the SR reduction of area at the time of evaluation of the weld joint reheat embrittlement resistance fell below 15%.

The fire-resistant steel of Steel No. 62 is an example where the amount of N was excessive, coarse nitrides were formed, and the toughness of the steel material, toughness at the time of large heat-input welding, and SR reduction of area at the time of evaluation of weld joint reheat embrittlement resistance all fell.

The fire-resistant steel of Steel No. 63 is an example where when B was added, a large amount of BN was precipitated at the weld joint heat affected zone grain boundaries and the SR reduction of area at the time of evaluation of the reheat embrittlement resistance was less than 15%.

The fire-resistant steel of Steel No. 64 is an example where the amount of 0 was high, so oxide clusters were formed and the toughness of the steel material and HAZ toughness at the time of large heat-input welding fell.

The fire-resistant steel of Steel No. 65 is an example where the content of P was high, while the fire-resistant steel of Steel No. 66 is an example where the content of S was high. In both cases, the toughness of the steel material and the SR reduction of area at the time of evaluation of the weld joint reheat embrittlement resistance were less than 15%.

The fire-resistant steel of Steel No. 67 is an example where the amount of addition of Ti was too large and all of the toughness of the steel material, toughness at the time of large heat-input welding, and SR reduction of area at the time of evaluation of the weld joint reheat embrittlement resistance fell.

The fire-resistant steel of Steel No. 68 is an example where the amount of addition of Zr was too large, Zr carbides precipitated coarsely and in large amounts, and all of the toughness of the steel material, toughness at the time of large heat-input welding, and SR reduction of area at the time of evaluation of the weld joint reheat embrittlement resistance fell.

The fire-resistant steel of Steel No. 69 is an example where the amount of addition of Ca was excessive, the fire-resistant steel of Steel No. 70 is an example where the amount of addition of Mg was excessive, the fire-resistant steel of Steel No. 71 is an example where the amount of addition of Y was excessive, the fire-resistant steel of Steel No. 72 is an example where the amount of addition of Ce was excessive, and the fire-resistant steel of Steel No. 73 is an example where the amount of addition of La was excessive. All are examples where oxide clusters were formed and the toughness of the steel material and the HAZ toughness at the time of large heat-input welding fell. Note that, in Steel No. 70, due to the addition of Mg, refinement of the grains of the structure of the HAZ due to the dispersion of oxides was seen and large heat input HAZ toughness could not be obtained.

The fire-resistant steel of Steel No. 74 is an example where chemical ingredients were all in the prescribed range of the present invention, but the SRS value became negative, so the SR reduction of area at the time of evaluation of the reheat embrittlement resistance fell below 15%.

The fire-resistant steel of Steel No. 75 is an example where the heating temperature before rolling was too high, the crystal grains became coarsened, and the toughness of the steel material fell.

The fire-resistant steel of Steel No. 76 is an example where the rolling end temperature fell, the chemical ingredients satisfied the present invention steel, but the quenching was insufficient and the dislocation density in the base material structure became low, and the room temperature and 600° C. yield strength targets could not be stably achieved. Note that, as the method of measurement of the dislocation density in the examples, the above-mentioned "method of evaluation from half width of X-ray diffraction peak" was used.

The fire-resistant steel of Steel No. 77 is an example where the water rate density fell at the time of cooling after the end of rolling, the cooling speed fell, the apparent quenchability fell, and the room temperature and 600° C. yield strength target could not be stably achieved.

The fire-resistant steel of Steel No. 78 is an example where the water cooling stop temperature was set too high, the chemical ingredients were in the range of the invention steels, but the room temperature and the 600° C. high temperature yield strength targets could not be stably achieved.

The fire-resistant steel of Steel No. 79 is an example where the tempering temperature was too high, so the heat treatment temperature exceeded the Ac1 transformation point (about 740° C.) resulting in a two-phase region, conversely the quenched structure and the tempering structure became mixed, and the room temperature yield strength exceeded the defined upper limit value.

The fire-resistant steel of Steel No. 80 is an example where the quenching time was too long and as a result the dislocation density of the structure remarkably fell and the room temperature and 600° C. yield strength target could not be stably obtained.

Due to the examples explained above, it is clear that the fire-resistant steel of the present invention was superior in toughness and high temperature strength and was superior in weld joint reheat embrittlement resistance.

INDUSTRIAL APPLICABILITY

According to the present invention, provision of fire-resistant steel for building use superior in toughness and high temperature strength and superior in weld joint reheat embrittlement resistance becomes possible, so the industrial applicability is large.

The invention claimed is:

1. A fire-resistant steel having weld joint reheat embrittlement resistance and toughness and a room temperature strength of 400 to 600N/mm$^2$ class, consisting of, by mass %, C: 0.010% to less than 0.05%,
Si: 0.01 to 0.50%,
Mn: 0.80 to 2.00%,
Cr: 0.50% to less than 2.00%,
V: 0.03 to 0.30%,
Nb: 0.01 to 0.10%,
N: 0.001 to 0.010%, and
Al: 0.005 to 0.10%,
limiting contents of Ni, Cu, Mo, and B to
Ni: less than 0.10%,
Cu: less than 0.10%,
Mo: 0.10% or less, and
B: less than 0.0003%,
further limiting contents of impurity ingredients of P, S, and O to
P: less than 0.020%, S: less than 0.0050%, and
O: less than 0.010%, and
a balance of iron and unavoidable impurities, wherein
Cr, Mo, Ni, Cu, and Mn satisfy the following formula (1):

$$4Cr[\%]-5Mo[\%]-10Ni[\%]-2Cu[\%]-Mn[\%]>0 \quad (1)$$

where, in formula (1), the units of the concentrations of the elements are mass %, wherein a dislocation density in a ferrite phase of said steel material is $10^{10}/m^2$ or more, said steel material structure has an occupancy of bainite or martensite in a structure viewed under an optical microscope of 20% or more and is comprised of a quenched structure, and in said steel material, carbides or nitrides comprising one or more of Nb, V, and Cr are precipitated by a $2/\mu m^2$ or higher density.

2. A fire-resistant steel having weld joint reheat embrittlement resistance and toughness as set forth in claim 1, wherein the steel has a high temperature yield strength at 600° C. of at least ½ of the prescribed yield strength at room temperature.

3. A fire-resistant steel having weld joint reheat embrittlement resistance and toughness and a room temperature strength of 400 to 600N/mm$^2$ class, consisting of, by mass %,
C: 0.010% to less than 0.05%,
Si: 0.01 to 0.50%,
Mn: 0.80 to 2.00%,
Cr: 0.50% to less than 2.00%,
V: 0.03 to 0.30%,
Nb: 0.01 to 0.10%,
N: 0.001 to 0.010%, and
Al: 0.005 to 0.10%,
limiting contents of Ni, Cu, Mo, and B to
Ni: less than 0.10%,
Cu: less than 0.10%,
Mo: 0.10% or less, and
B: less than 0.0003%,
further limiting contents of impurity ingredients of P, S, and O to
P: less than 0.020%,
S: less than 0.0050%,
O: less than 0.010%,
one or both of Ti: over 0.005% to less than 0.050% and
Zr: 0.002 to 0.010%, and
a balance of iron and unavoidable impurities,
wherein Cr, Mo, Ni, Cu, and Mn satisfy the following formula (1):

$$4Cr[\%]-5Mo[\%]-10Ni[\%]-2Cu[\%]-Mn[\%]>0 \quad (1)$$

where, in formula (1), the units of the concentrations of the elements are mass %, wherein a dislocation density in a ferrite phase of said steel material is $10^{10}/m^2$ or more, said steel material structure has an occupancy of bainite or martensite in a structure viewed under an optical microscope of 20% or more and is comprised of a quenched structure, and in said steel material, carbides or nitrides comprising one or more of Nb, V, Cr, Ti, and Zr are precipitated by a $2/\mu m^2$ or higher density.

4. A fire-resistant steel having weld joint reheat embrittlement resistance and toughness as set forth in claim 3, wherein the steel has a high temperature yield strength at 600° C. of at least ½ of the prescribed yield strength at room temperature.

5. A fire-resistant steel having weld joint reheat embrittlement resistance and toughness and a room temperature strength of 400 to 600N/mm$^2$ class, consisting of, by mass %,
C: 0.010% to less than 0.05%,
Si: 0.01 to 0.50%,
Mn: 0.80 to 2.00%,
Cr: 0.50% to less than 2.00%,
V: 0.03 to 0.30%,
Nb: 0.01 to 0.10%,
N: 0.001 to 0.010%, and
Al: 0.005 to 0.10%,
limiting contents of Ni, Cu, Mo, and B to
Ni: less than 0.10%,
Cu: less than 0.10%,
Mo: 0.10% or less, and
B: less than 0.0003%,
further limiting contents of impurity ingredients of P, S, and O to
P: less than 0.020%,
S: less than 0.0050%,
O: less than 0.010%,
one or more of
Mg: 0.0005 to 0.005%,
Ca: 0.0005 to 0.005%,
Y: 0.001 to 0.050%,
La: 0.001 to 0.050%, and
Ce: 0.001 to 0.050%, and
a balance of iron and unavoidable impurities,
wherein Cr, Mo, Ni, Cu, and Mn satisfy the following formula (1):

$$4Cr[\%]-5Mo[\%]-10Ni[\%]-2Cu[\%]-Mn[\%]>0 \quad (1)$$

where, in formula (1), the units of the concentrations of the elements are mass %, wherein a dislocation density in a ferrite phase of said steel material is $10^{10}/m^2$ or more, said steel material structure has an occupancy of bainite or martensite in a structure viewed under an optical microscope of 20% or more and is comprised of a quenched structure, and in said steel material, carbides or nitrides comprising one or more of Nb, V, and Cr are precipitated by a $2/\mu m^2$ or higher density.

6. A fire-resistant steel having weld joint reheat embrittlement resistance and toughness as set forth in claim 5, wherein the steel has a high temperature yield strength at 600° C. of at least ½ of the prescribed yield strength at room temperature.

* * * * *

UNITED STATES PATENT AND TRADEMARK OFFICE

CERTIFICATE OF CORRECTION

PATENT NO. : 8,715,432 B2
APPLICATION NO. : 12/452200
DATED : May 6, 2014
INVENTOR(S) : Yasushi Hasegawa et al.

It is certified that error appears in the above-identified patent and that said Letters Patent is hereby corrected as shown below:

In the Claims:

Column 7, line 19, change "regions" to -- regions. --;

Column 13, line 60, change "average strain $\epsilon$" to -- average strain $\varepsilon$ --;

Column 13, line 61, change "$\epsilon$" to -- $\varepsilon$ --;

Column 13, line 63, change "average strain $\epsilon$," to -- average strain $\varepsilon$, --;

Column 13, line 64, change "$\{\rho = 14.4\epsilon^2/b^2\}$" to -- $\{\rho = 14.4\varepsilon^2/b^2\}$ --.

Signed and Sealed this
Twenty-first Day of October, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,715,432 B2
APPLICATION NO. : 12/452200
DATED : May 6, 2014
INVENTOR(S) : Yasushi Hasegawa et al.

It is certified that error appears in the above-identified patent and that said Letters Patent is hereby corrected as shown below:

In the Specification:

Column 7, line 19, change "regions" to -- regions. --;

Column 13, line 60, change "average strain $\epsilon$" to -- average strain $\varepsilon$ --;

Column 13, line 61, change "$\epsilon$" to -- $\varepsilon$ --;

Column 13, line 63, change "average strain $\epsilon$," to -- average strain $\varepsilon$, --;

Column 13, line 64, change "$\{\rho = 14.4\epsilon^2/b^2\}$" to -- $\{\rho = 14.4\varepsilon^2/b^2\}$ --.

This certificate supersedes the Certificate of Correction issued October 21, 2014.

Signed and Sealed this
Eleventh Day of November, 2014

Michelle K. Lee

Michelle K. Lee
*Deputy Director of the United States Patent and Trademark Office*